US012523046B2

(12) United States Patent
Boucké et al.

(10) Patent No.: US 12,523,046 B2
(45) **Date of Patent: *Jan. 13, 2026**

(54) PANEL FOR COMPOSING A FLOOR COVERING OR WALL COVERING, PANEL SYSTEM, AND METHOD

(71) Applicant: I4F Licensing NV, Turnhout (BE)

(72) Inventors: Eddy Alberic Boucké, Turnhout (BE); Pieter Renaat Karel Devos, Koolskamp (BE)

(73) Assignee: i4F Licensing NV, Turnhout (BE)

( * ) Notice: Subject to any disclaimer, the term of this patent is extended or adjusted under 35 U.S.C. 154(b) by 0 days.

This patent is subject to a terminal disclaimer.

(21) Appl. No.: 18/611,211

(22) Filed: Mar. 20, 2024

(65) Prior Publication Data

US 2024/0229475 A1 Jul. 11, 2024

Related U.S. Application Data

(63) Continuation of application No. 18/059,149, filed on Nov. 28, 2022, now Pat. No. 11,946,262.

(30) Foreign Application Priority Data

Aug. 11, 2022 (NL) ..... 2032731

(51) Int. Cl.

| | |
|---|---|
| ***E04F 15/00*** | (2006.01) |
| ***E04F 13/08*** | (2006.01) |
| ***E04F 15/02*** | (2006.01) |

(52) U.S. Cl.

CPC .... *E04F 15/02038* (2013.01); *E04F 13/0803* (2013.01); *E04F 13/0894* (2013.01); *E04F 15/02044* (2013.01); *E04F 15/02183* (2013.01); *E04F 2015/02061* (2013.01); *E04F 15/02161* (2013.01); *E04F 2201/0123* (2013.01); *E04F 2201/0161* (2013.01);

(Continued)

(58) Field of Classification Search

CPC ..... E04F 15/02033; E04F 15/02038; E04F 15/107; E04F 15/102; E04F 2201/042; E04F 2201/0107; E04F 2201/03; E04F 15/0803; E04F 13/0894; E04F 15/02044; E04F 15/02183; E04F 2015/02161; E04F 2201/0123; E04F 2201/0161; E04F 2201/021; E04F 2201/0552; E04F 2201/023; E04F 2201/0535; E04F 2201/0146; E04F 2201/043; E04F 2201/0547; E04F 2201/0153; E04F 2201/0138; E04F 2290/00

See application file for complete search history.

(56) References Cited

U.S. PATENT DOCUMENTS

| | | | |
|---|---|---|---|
| 5,050,362 | A | 9/1991 | Tal et al. |
| 6,122,877 | A | 9/2000 | Hendrickson et al. |
| 6,199,340 | B1 | 3/2001 | Davis |

(Continued)

FOREIGN PATENT DOCUMENTS

| | | | |
|---|---|---|---|
| DE | 102013200349 | A1 | 11/2013 |
| WO | 2013126693 | A2 | 8/2013 |
| WO | 2022078937 | A1 | 4/2022 |

*Primary Examiner* — Chi Q Nguyen

(74) *Attorney, Agent, or Firm* — The Webb Law Firm

(57) ABSTRACT

A panel for composing a floor covering or wall covering. A panel system including at least one panel. A method of composing a covering, in particular a floor covering, by using a panel system.

21 Claims, 10 Drawing Sheets

(52) U.S. Cl.
CPC ... *E04F 2201/021* (2013.01); *E04F 2201/043* (2013.01); *E04F 2290/00* (2013.01)

(56) References Cited

U.S. PATENT DOCUMENTS 6,584,748 B2 7/2003 Bresnahan
6,588,166 B2 * 7/2003 Martensson ..... E04B 1/6129 52/592.1
6,955,020 B2 * 10/2005 Moriau ..... B27C 5/00 52/480
8,528,296 B1 9/2013 Miller
8,793,956 B2 * 8/2014 Leopolder ..... E04F 13/08 52/592.1
9,206,614 B2 12/2015 Richardson et al.
9,347,226 B2 5/2016 Ouellet
9,394,698 B2 7/2016 Carrubba
9,567,753 B2 * 2/2017 Pervan ..... E04F 15/02038
10,947,741 B2 * 3/2021 Boucké ..... E04F 15/10
11,578,495 B2 * 2/2023 Quist ..... E04F 15/107
11,946,262 B2 * 4/2024 Boucké ..... E04F 15/105
2003/0009971 A1 1/2003 Palmberg
2005/0055938 A1 3/2005 Secondino
2005/0108969 A1 5/2005 Whitaker
2006/0137280 A1 * 6/2006 Bartnes ..... F24D 13/022 52/582.2
2008/0072514 A1 3/2008 Barlow
2010/0300027 A1 12/2010 Bravo et al.
2013/0167458 A1 7/2013 Cerny et al.
2016/0340899 A1 11/2016 Piccone
2019/0119863 A1 4/2019 Penland, Jr. et al.
2024/0229475 A1 * 7/2024 Boucké ..... E04F 15/02044

* cited by examiner

PANEL FOR COMPOSING A FLOOR COVERING OR WALL COVERING, PANEL SYSTEM, AND METHOD

CROSS-REFERENCE TO RELATED APPLICATION

This application is a continuation application of U.S. patent application Ser. No. 18/059,149, filed Nov. 28, 2022, now U.S. Pat. No. 11,946,262, which claims priority to The Netherlands Patent Application No. 2032731 filed Aug. 11, 2022, the disclosures of which are hereby incorporated by reference in their entireties.

BACKGROUND OF THE INVENTION

Field of the Invention

The invention relates to a panel for composing a floor covering, wall covering, or alternative covering, in particular for outdoor applications. The invention also relates to a panel system comprising at least one panel according to the invention. The invention further relates to a method of composing a covering, in particular a floor covering, by using a panel system according to the invention.

Description of Related Art

As is known, outdoor panels can be used to compose an outdoor floor covering in exterior environments of structures, for example balconies, terraces, swimming pools, gardens and courtyards. These panels serve to improve the appearance of the environment while also providing a solid and robust floor surface. Typically, these outdoor panels have identical side grooves at opposing side edges, which are used to co-act with metal or plastic fastening clips to fasten the panels onto a support structure. The use of these clips is laborious, time-consuming, wherein installation can normally only be performed by an educated installer. Moreover, since these panels are installed in exterior environments, the panels are commonly exposed to water, from rain or irrigation systems for example, as a consequence of which the water may stand on the surfaces of the tiles, forming puddles which are not only visually displeasing but may also lead to the formation of mosses on the surface of the panels. The water may also make the panels more slippery.

SUMMARY OF THE INVENTION

It is a first objective of the invention to provide a panel and/or a panel system which can be installed in a relatively user-friendly manner.

It is a second objective of the invention to provide an improved panel and/or improved panel system which can be installed in a relatively user-friendly manner, and which may be configured to drain water in an efficient manner.

It is a third objective of the invention to provide a light-weight panel and/or a light-weight panel system comprising at least one light-weight panel, which can be installed in a relatively user-friendly manner.

It is a fourth objective of the invention to provide an alternative panel and/or alternative panel system, which, according to some of its embodiments, is intended to resolve one or more of the problems arising from the prior art.

It is a fifth objective of the present invention is to overcome the aforesaid drawbacks of the prior art, in the context of a simple, rational and inexpensive solution.

To achieve one or more of these objectives, the invention provides a panel according to the preamble, comprising:

- a first edge which comprises at least one coupling profile, preferably a plurality of first coupling profiles, and
- a second edge, preferably located opposed to the first edge, which comprises at least one second coupling profile, preferably a plurality of second coupling profiles, wherein each second coupling profile is configured to engage interlockingly with at least one first coupling profile of an adjacent panel,
- wherein said first edge and/or said second edge preferably comprises at least one segment which is free of coupling profiles, wherein said segment, preferably a drainage segment, and if applied, is configured to facilitate flow-through of water in between the first edge of said panel and a facing second edge of an adjacent panel, in coupled condition of said panels.

This interlocking is preferably such that said panel can be locked with respect to another panel in horizontal direction and/or vertical direction, preferably in both directions.

The panel according to the invention, which can be used as outdoor panel and/or as indoor panel, is preferably provided with one or more coupling profiles, which allow adjacent panels to be interlocked essentially and preferably without using separate clips and/or other mechanical or chemical fastening means, and/or which allow adjacent panels to be interlocked essentially by using less separate clips and/or other mechanical or chemical fastening means. This leads to a relatively user-friendly installation, without needing educated installers. Moreover, since the coupling profiles lock adjacent panels in horizontal and/or vertical direction, undesired uncoupling of the coupling profiles, and hence of the panels, can be counteracted. As indicated, the panel according to the invention preferably comprises at the first edge a plurality of first coupling profiles and/or comprises at the second edge a plurality of second coupling profiles. The application of a plurality of coupling profiles at a panel edge allows to create a distance between adjacent coupling profiles, which leads to a(n intermediate) segment which is preferably substantially free of any coupling profiles, which, as such, leads to a material saving, and hence a weight saving, as less material is needed to realize an interlockable panel. This leads to economical, environmental and practical benefits. One or more intermediate segment(s) of the panel edge(s) may also be free of any protruding elements laterally protruding from said panel edge. The intermediate segment(s) does not only lead to a material and weight saving, but may also be used to facilitate water drainage via said segment(s), in particular in coupled condition of adjacent panels. This allows water to be drained via one or more spaces enclosed by the first edge and facing second edge of interlocked adjacent panels. The width of this space may strongly vary, dependent on the specific panel design and/or intended application. The width of this intermediate space (or seam) enclosed by interlocked panels is preferably situated in between 0 and 10 millimetre, more preferably in between 10 micron and 6 millimetre.

In this case, the segment(s) may also be referred to as drainage segment(s). Drainage of water is typically important for outdoor application of the panel, but may also be(come) important for specific (or less specific) indoor applications, such as for example in wet indoor environments, such as indoor swimming pools or bathrooms, and/or in indoor spaces where wet cleaning is preferably regularly applied, such as in industrial spaces, commercial spaces, and/or residential spaces.

In a preferred embodiment, at least one (drainage) segment is enclosed by adjacent coupling profiles. As said, said segment is preferably free of any coupling profiles. It may be preferred that at least a part of at least one (drainage) segment is substantially delimited, preferably substantially entirely delimited, by a vertical plane defined by the corresponding edge. Said segment of the panel may be provided with at least one laterally protruding element for supporting an adjacent panel, in coupled condition of said panel, wherein said protruding element preferably does not contribute to interlocking of panels in coupled condition. It is also, typically additionally, imaginable that at least one segment is positioned at an outer portion of a side edge, wherein said segment is only one-sided delimited by one coupling profile.

Preferably, at least one edge of the first edge and second edge comprises at least three coupling profiles, wherein a segment, in particular drainage segment, is present in between each pair of adjacent first coupling profiles. Preferably, the coupling profiles are spread, more preferably substantially evenly, along the edge to secure a decent coupling along the practically entire edge. Preferably, the number of first coupling profiles corresponds to the number of second coupling profiles.

Preferably, the first edge comprises at least one first drainage segment, and the second edge comprises at least one second drainage segment. In this manner, water will be facilitated to be drained along both the first and second panel edge, and preferably along all panel edges. Preferably, at least one first drainage segment is at least partially aligned with at least one second drainage segment, such that said first drainage segment of said panel is facing said second drainage segment of an adjacent panel, in coupled condition of said panels. This preferably leads to open (linear) through-hole cavities connecting the upper side and the lower side of a covering composed of interlocked panels.

Preferably, at least one first coupling profile is at least partially aligned with at least one second coupling profile. This facilitates to realize a reliable interconnection between panels. It is conceivable that at least one first coupling profile has an identical length or deviating length (greater or smaller length), as seen in the direction of the first edge, compared to the length of the second coupling profile, as seen in the direction of the second edge. Preferably, the length of at least one first drainage segment exceeds the length of at least one second drainage segment (as seen in the direction of the first and second edges respectively). It may be preferred that the length of at least one drainage segment exceeds the length of at least one adjacent coupling profile. This may further improve the drainage capacity of a (floor) covering composed of a plurality of said panels. It may also, additionally or alternatively, be preferred that the length of at least one coupling profile exceeds the length of at least one adjacent coupling profile. This may further improve the coupling strength of interlocked panels.

In a preferred embodiment, at least one first coupling profile comprises:

a sideward tongue extending in a direction substantially parallel to a plane defined by the panel, wherein an upper side of said sideward tongue comprises at least one first locking element, such as an upwardly protruding locking element; and wherein at least one second coupling profile comprises:

a groove configured for accommodating at least a part of the sideward tongue of at least one first coupling profile of an adjacent panel, said groove being defined by an upper lip and a lower lip, wherein said lower lip extends beyond said upper lip, and wherein a lower side of said upper lip comprises at least one second locking element, such as a downwardly facing recess, configured to face, and preferably co-act with, the first locking element of an adjacent panel, in coupled condition of said panels to interlock the panels in horizontal direction.

A locking effect in vertical direction is realized by inserting the sideward tongue of a panel at least partially into the groove of an adjacent panel. Preferably, the first and second coupling profile are configured such that two of such panels can be coupled to each other by means of a turning movement and/or translation movement (preferably in a horizontal plane), wherein, in coupled condition: at least a part of the sideward tongue of a first panel is inserted into the groove of an adjacent, second panel, and wherein at least one second locking element of said first panel faces, and preferably co-acts with, the first locking element of said adjacent panel to interlock both panels both in horizontal and vertical direction.

The lower lip preferably comprises an inner segment, which is positioned directly below the upper lip, and a connecting outer segment, which extends beyond an outer vertical plane defined by the upper lip, wherein the maximum height of the inner segment is identical to or exceeds the maximum height of the outer segment. Hence, the upper surface of a lower lip is preferably substantially planar. It is however imaginable that said upper surface of the lower lip, preferably the outer segment of the lower lip, comprises at least one upward drainage groove. Such a drainage groove (further) facilitates drainage of water, such as water seep in between the coupling profiles.

Preferably, the lower lip of said panel is configured to engage a stop surface of the second profile of an adjacent panel, in coupled condition of said panels, wherein said stop surface is located at a lower level than the sideward tongue. Said stop surface is typically preferably to secure a minimum distance in between top sections of interlocked panels, which typically results in an open seam at the top sections in between interlocked panels which is in favour of the drainage capacity of the covering at least partially formed by said interlocked panels. Preferably, the first coupling profile comprises a first top portion located above the sideward tongue, wherein said first top portion preferably extends in a substantially vertical direction, and wherein an outer end of the upper lip defines a second top portion, wherein said second top portion preferably extends in a substantially vertical direction, and wherein said second top portion is configured to face the first top portion of an adjacent panel, in coupled condition of said panels, preferably such that the first top portion and the facing second top portion are positioned at a distance from each other. As said above, this open (top) seam improves the drainage capacity of the covering at least partially formed by said interlocked panels.

The stop surface is preferably a vertical stop surface. The distant end surface of the lower lip, configured to co-act with said stop surface of another panel, is preferably also oriented substantially vertically, which normally easily leads to a stable abutment of both substantially vertical surfaces. Preferably, a lower side of the panel is provided with a longitudinal cut-out portion connecting and parallel to the first edge for accommodating each lower lip in coupled condition of adjacent panels. Said cut-out portion is preferably partially defined by said stop surface and partially by a connecting horizontal part of the lower side of the panel.

The first locking element is preferably formed by at least one bulge, and the second locking element is preferably formed by at least one recess to accommodate said at least one bulge at least partially. This embodiment results in a more robust, and hence stronger, sideward tongue. Preferably, the bulge and/or the recess preferably has a rounded triangular shape, with typically two straight legs being connected by a rounded vertex. The curvature of the vertexes of the bulge and recess may be identical, wherein it is preferred though that a radius defining the vertex of the bulge exceeds the radius defining the vertex of the recess. This makes the bulge less sharp, and therefore less vulnerable for breakage. An inversed embodiment is also imaginable, wherein the first locking element may be formed by at least one recess, and the second locking element may be formed by at least one bulge to accommodate said at least one bulge at least partially. Alternative locking elements and/or other combinations of bulges and recesses are also imaginable as first locking element and second locking element.

Preferably, at least one lower lip is provided with at least one curved side edge, preferably two curved side edges, preferably as seen from a top view of the lower lip. Such curved side edges make the lower lip typically less vulnerable for damaging and/or breaking. The lower lip typically serves for supporting the sideward tongue in coupled condition of adjacent panels. Preferably, in coupled condition of adjacent panels, the sideward tongue is supported both by said inner segment and by said outer segment of the lower lip. Preferably, a distant end portion of the lower side of the sideward tongue, positioned below the first locking element, as said preferably formed by at least one bulge, is at least partially inclined upwardly towards the outer end of the sideward tongue. This inclination creates space which facilitates coupling of the coupling profiles, in particular which facilitates angling in of the sideward tongue into the groove. The outer end of the sideward tongue is preferably substantially vertical, which typically contributes to the robustness of the sideward tongue.

Preferably, at least one sideward tongue is provided with at least one curved and/or chamfered (inclined) side edge, preferably two curved and/or chamfered (inclined) side edges, preferably as seen from a top view of the sideward tongue. These one or more side edges may act as guiding surfaces for aligning the panel(s) with respect to a support structure.

At least two first coupling profiles, in particular as seen from a cross-sectional view, may be identical. Additionally or alternatively, at least two first coupling profiles, in particular as seen from a cross-sectional view, are mutually different. At least two first coupling profiles, in particular as seen from a top view, are mirror symmetric first coupling profiles. In this embodiment, the mirror symmetric first coupling profiles are preferably separated by an intermediate segment, in particular a drainage segment, which makes the two adjacent first coupling profiles look like an interrupted larger first coupling profile being divided into two smaller first coupling profiles. Said (fictive) larger first coupling profile may have the same length (as seen in the direction of the first edge) which as another (undivided) first coupling profiled located at said first edge. The same applies to the second coupling profiles which may be identical and/or deviating coupling profiles. At least two second coupling profiles, in particular as seen from a top view, may be mirror symmetric second coupling profiles.

In a preferred embodiment, at least one pair of at least one pair of adjacent first coupling profiles and at least one pair of opposing adjacent second coupling profiles encloses an accommodating space for accommodating a separate support structure for supporting said panel, wherein accommodating spaces are aligned with each other. Said accommodating space is typically a groove of limited length, which, in coupled condition of adjacent panels, preferably overlaps and/or coincides with an accommodating space of a connecting pair of coupling profiles. By inserting a part of the supporting support structure into said accommodating space(s) a more stable (floor) covering, and panel system as such (comprising interlocked panels supported by one or more support structures), can be obtained. Preferably, an upper side of each accommodating space is at least partially defined by a curved and/or inclined surface. This embodiment typically facilitates the insertion of (a(n upper) part of) the support structure into the accommodating space(s).

Preferably, the lower side of the panel comprises at least one bottom groove, preferably transverse bottom groove, preferably connecting the first edge and the second edge (or one or more other edges), wherein said bottom groove, preferably transverse bottom groove, is configured to accommodate a separate support structure for supporting said panel, and wherein the bottom groove, preferably transverse bottom groove, is preferably connected and aligned with a pair of opposing, aligned accommodating spaces (preferably as mentioned above) to form a continuous accommodating groove for accommodating a part of said separate support structure. Such a continuous bottom groove, preferably transverse bottom groove, renders it relatively easy to be placed on top of the (first) support structure, such that a part of said (first) support structure is accommodated within said continuous groove. Preferably, at least one accommodating space and/or at least one bottom groove, preferably transverse bottom groove, comprises at least one third coupling profile configured to interlockingly engage with at least one fourth coupling profile of said separate support structure, in horizontal direction and/or vertical direction. Realizing a coupling between the third profile and the fourth profiles is preferably done by placing the panel(s) on top of said (first) support structure and by subsequently translating (shifting) the panel(s) in horizontal direction make the third coupling profile and fourth coupling profile to interlockingly engage onto each other. Preferably, a clamping connection between the third coupling profile and the fourth coupling profile is realized in coupled condition of adjacent panels. The bottom groove, preferably transverse bottom groove, normally extends in transverse direction perpendicular to the length direction of the panel, and preferably perpendicular to the first edge and second edge. This embodiment typically provides a preferred stability of a panel covering supported by one or more (first) support structures, wherein the panels and the support structures are oriented in crosswise direction. It is however also imaginable that the bottom groove, preferably transverse bottom groove, extends in length direction of the panel.

Preferably, the first coupling profiles and/or second coupling profiles and/or third coupling profiles, more preferably all coupling profiles, make integral part of the panel, in particular a core of the panel. More preferably, the coupling profiles are at least partially formed by means of extrusion, preferably simultaneously with at least one layer, such as a core layer, of the panel. Said layer and the coupling profiles may therefore be made out of one piece of material. It is well imaginable that the coupling profiles are milled and/or otherwise brought into their final shape (also in length direction parallel to the first and second side edges) after extrusion. This latter post-processing step is typically done in order to create the segments, in particular the drainage segments. However, the latter processing step may also be incorporated in an extrusion process step, preferably in a co-extrusion process step. By incorporating the processing steps e.g. in a single co-extrusion process this may achieve benefits in terms of both cost and processing speed.

Preferably, a second pair of opposing edges, typically formed by a third edge and fourth edge, of the panel is entirely free of coupling profiles. Preferably these opposing edges are defined by substantially vertical end surfaces.

The panel is preferably a rectangular and/or oblong panel, more preferably a rectangular oblong panel. Other polygonal shapes, such as triangular, hexagonal or octagonal shapes or parallelogrammatic shapes are also imaginable for the panel according to the invention.

Although the covering (at least partially) composed of a plurality of interconnected panels according to the invention is preferably water permeable to allow water drainage, the panels as such are preferably water-resistant panels. Water-resistant means that the panels are dimensionally stable when exposed the water (and will e.g. not cup, expand, or shrink). It is imaginable and even favourable in case the panel is a substantially rigid panel. The panel may be used as indoor panel or as outdoor (decking) panel. The panels may also be referred to as tiles, planks, or decking boards, or covering elements, in particular floor covering elements or wall covering elements. Preferably, the length of the panel is situated in between 1 and 4 meter, preferably between 1.5 and 4 meter, more preferably between 3 and 4 meter, in particular up to 6 meter. This latter preferred range is in particular preferred in case the panel is used as outdoor panel. The thickness of the panel is preferably situated in between 3 and 80 millimetre, more preferably between 8 and 60 millimetre, most preferably between 10 and 55 millimetre. This latter range is in particular preferred in case the panel is used as outdoor panel. The width of the panel is preferably situated in between 10 and 300 millimetre, more preferably between 40 and 250 millimetre, most preferably between 80 and 200 millimetre. This latter range is in particular preferred in case the panel is used as outdoor panel.

Preferably, the panel is at least partially an extruded panel, and preferably an entirely extruded panel, more preferably an entirely co-extruded panel. In a co-extruded panel two or more layers are simultaneously formed on top of each other (and/or side by side of each other) by using different adjacent extruders. This allows different panel layers to be composed of different compositions, which may lead to improved overall properties of the panel, such as acoustic properties (sound dampening properties), and/or anti-slip properties, and/or an improved user comfort. The coupling profiles may be formed by a single layer, although it is also imaginable that at least one coupling profile is partially formed by one layer and at least one other part of said coupling profile is formed by at least one other layer.

The panel according to the invention may be a monolithic panel. This means that the panel is entirely formed out of a single piece of material. However, the panel may also be a multi-layered panel, preferably a co-extruded multi-layered panel. Such a multi-layered panel preferably comprises a core layer and a top structure and/or a backing layer, directly or indirectly, affixed to said core layer. The top structure as such may also be composed of a plurality of layers, which may include, for example a décor layer, preferably a digitally printed décor layer, and at least one transparent and/or translucent cover layer. Preferably, the top structure comprises at least one primer layer applied onto the core layer, at least one, preferably printed, décor layer applied onto the (upper) primer layer, and at least one transparent and/or translucent wear layer on top of the décor layer, and optionally a top coating applied on top of the (upper) wear layer. It is, however, also conceivable that two or more layers of the top structure are formed by a single layer.

According to a preferred embodiment it is conceivable that the panel comprises a top structure, wherein said top structure, or a part thereof, at least partially covers the upper surface of the panel, and at least partially covers at least one side edge, preferably at least one of the first and/or second edge. Optionally the top structure substantially entirely covers at least one pair of opposing side edges, and possibly all side edges. It is imaginable one or more of the coupling profiles are at least partially covered by the top structure (or a part thereof). It is furthermore imaginable that said top structure or a part thereof, according to this embodiment, at least partially, preferably entirely, covers the bottom side of the panel. It is e.g. imaginable that the top structure comprises a primer layer which is present both at the upper surface of the panel, the bottom side of the panel, and optionally one or more side edges of the panel. This may give the panel an improved moisture resistance and/or may protect the panel against insects, fungi and/or bacteria.

It may be preferred to at least partially compose the top structure out of a polymer material. However, as indicated above, preferably the top structure comprises a plurality of (stacked) layers, including at least one optional primer layer, at least one decorative layer and at least one protective layer covering said decorative layer at least partially. According to this embodiment, a core of the panel may for example, in particular be composed out of wood and/or a wood/plastic composite structure.

Preferably, the panel is a hollow panel, which preferably encloses at least one internal, preferably linear, channel connecting a third edge and a fourth edge, wherein said internal channel is preferably located at a distance from both the lower side of the panel and/or the upper side of the panel, and wherein each of the third edge and fourth edge preferably connects the first edge and the second edge. Preferably, each channel is situated at a distance from both the first edge and the second edge. A plurality of these channels may be applied, preferably arranged in a side-by-side orientation (lateral orientation). The cross-sectional shape of the channel may for example, be round or polygonal, preferably polygonal with rounded corners. These one or more channels save material and weight. These one or more channels may easily be realized by means of extrusion, optionally by means of co-extrusion. In this latter case, at least one channel may partially be bordered by a first extruded panel layer and may for a remaining part be bordered by at least one other extruded panel layer. It is imaginable that the one or more channels are connected to the lower side of the panels. This typically leads to a panel with a rake-shaped or fork-shaped cross-section, wherein the channels of each pair of adjacent channels, if multiple channels are applied, are mutually separated by a downwardly extending leg. A lower portion of said leg may be widened with respect to the centre portion and/or upper portion of said leg. This may improve the stability of the panel.

The upper side of the panel may have a relief structure. This relief structure may be entirely functional, for example, to improve the anti-slip properties of the panel, but may also be aesthetical to improve the look and feel properties of the panel. A relief structure which is both functional and aesthetically attractive is also imaginable. The relief structure is, for example, an extruded relief structure and/or a pressed relief structure and/or a printed relief structure, preferably digitally printed relief structure. In an embodiment, the relief structure comprises a plurality of parallel oriented elongated excavations connecting the third edge and the fourth edge. These elongated excavations may also be referred to as top grooves. At least two of these excavations preferably run in parallel. Additionally or alternatively, at least two of these excavations may intersect and mutually enclose an angle, for example an angle of 90 degrees, 60, 45, or 30 degrees. Other angles are also possible. At least two excavations preferably run in length direction of the panel, which is typically, dependent on the panel design, parallel to the first and second edges. Such an orientation is often preferred from an aesthetic point of view. It is however also imaginable, and sometimes preferred, that the elongated excavations run in a transverse direction, thereby connecting the first edge and the second edge. This orientation typically reduces the length of the elongated excavations compared to a lengthwise orientation. This transverse orientation may however, be more efficient for drainage of water, as the water drainage path will be shortened in this way, starting from a centre portion of an excavation. Irrespective of the excavation orientation, it may be preferred that the depth of at least one excavation increases towards at least one edge to which said excavation connects, which may be the first edge, the second, the third edge, or the fourth edge (or another edge) depending on the panel and excavation design. Preferably, the depth of at least one excavation that increases from a central portion of the upper surface towards the third edge and fourth edge of the panel. Such inclination(s) may force water to move towards the edge(s) where the water can be drained. This typically reduces the slipperiness of the panel, in particular in wet condition, and moreover, reduces the risk of moss formation onto the panel(s).

The excavations preferably have a maximum depth greater than 0.1 millimetre, in particular 0.5 millimetre. The excavations may be formed in various way, for example by milling (excavating), by pressing, by printing, and/or during extrusion of the panel (or a part of the panel).

Preferably, the décor layer and/or relief structure is/are shaped to represent a pattern, such as a wood pattern, that is to say the veining and knots of a wood pattern, a stone or a concrete pattern, a resin or any other design or pattern, such as an—optionally customized—image pattern. Preferably, the pattern is at least partially formed by a printed graphic element. The printing is preferably carried out using contactless printing methods such as digital inkjet printing or screen printing, since this makes it possible to print in high resolution even on the irregular configuration of a distressed edge. However, there is no reason why other printing techniques such as flexography, offset printing or rotogravure should not be used. Evidently, the pattern may comprise a colour or black and white design, but it may also be formed by solid colouring, in which case other decorative techniques are possible, such as aerography or cascade or film decoration. It is also imaginable that the décor layer and/or relief structure covers not only the top side of the panel, but also other sides of the panel, such as one or more, e.g. two or four, sidewalls of the panels, and/or the lower side of the panel. It is also possible that the panel is decorated with a whole body technique, that is to say one in which at least one pigment is mixed, according to a predefined design or in a random manner, with a base material of the panel, which is typically a polymer material, such as a thermoplastic material, like PVC, PP, PET, TPU, etcetera, which colours a part or preferably the whole thickness of the panel rather than just its upper surface. Furthermore, there is no reason why the pattern should not be applied to a suitable pre-printed substrate to be fixed to the support, for example a sheet of paper or plastic, PVC for example, which is affixed, e.g. glued or welded, onto a core layer of the panel, in particular where the core layer is wood-based and/or polymer-based.

According to an embodiment of the invention, the lower side of the panel may comprise a second relief structure. In particular, the second relief structure may have one or more of the characteristics described in relation to the relief structure of the upper surface. Preferably, each surface may represent a specific pattern, so that, during installation, the user can choose which surface is to be visible. For example, the second relief structure may be substantially specular to the relief structure of the upper surface, so that the weight and quantity of material is substantially balanced between the surfaces.

In a preferred embodiment, the panel, or at least one panel layer, is at least partially composed of at least one polymer material, preferably a thermoplastic material, wherein said polymer material is preferably enriched with at least one filler. Preferably, the thermoplastic material is chosen from the group consisting of: PVC, PET, PP, PS, thermoplastic polyurethane (TPU), PE, in particular MDPE and/or HDPE; and combinations thereof. PS may be in the form of expanded PS (EPS) in order to further reduce the density of the panel, which leads to a saving of costs and facilitates handling of the panels. Also in case another thermoplastic material is used, this material may be applied in foamed state in the core to reduce the density and costs. Nevertheless, it is also imaginable, and typically preferred, that the thermoplastic material used as main polymer is a solid polymer (i.e. an unfoamed polymer). Preferably, at least a fraction of the polymer used may be formed by recycled thermoplastic, such a recycled PVC or recycled PU. An advantage of thermoplastic material is that this material is typically suitable to be extruded, which allows the panel, or at least a part thereof, to be made by means of extrusion and/or co-extrusion. It is conceivable that a mix of virgin and recycled thermoplastic material is used to compose at least a part of the core. Instead of the thermoplastic material, also a thermoset polymer may be used, such as thermoset polyurethane.

As indicated above, said at least one polymer is preferably enriched with at least one filler. These one or more fillers can be applied to provide additional desired properties to said polymer(s) and/or to said panel. Preferably, at least one filler is preferably selected from the group consisting of: talc, chalk, wood, bamboo, cotton, coffee, limestone, calcium carbonate, titanium dioxide, calcined clay, porcelain, glass, carbon particles, metal, silicon particular, a(nother) mineral filler, such as marble dust, a(nother) natural filler, a(nother) (auxiliary) polymer, such as an elastomer and/or latex. It is also imaginable that rubber and/or elastomeric parts (particles) are dispersed within the polymer (matrix) to improve the flexibility and/or impact resistance at least to some extent. Although the panel is preferably rigid, the panel may also be semi-flexible, or flexible. The filler may be formed by fibres, such as glass fibers or synthetic or genuine leather fibers, and/or may be formed by dust-like particles. Here, the expression "dust" is understood as small dust-like particles (powder), like bamboo dust, wood dust, cork dust, or non-wood dust, like mineral dust, stone powder, in particular cement, and combinations thereof. The average particle size of the dust is preferably between 14 and 20 micron, more preferably between 16 and 18 micron. The filler may also be in the form of at least one layer, such as a woven and/or non-woven layer, preferably used to reinforce the panel. Hence, such a layer may also be referred to reinforcement layer. Alternatively or additionally, the filler may be in the form at least one filament, preferably a reinforcement filaments. These filaments are typically continuous strands and/or continuation filament yarns. These filler layer(s) and/or filler filament(s) are typically embedded in the polymer, and preferably extend between at least two opposing panel edges. This embedment can e.g. be realized by means of extrusion, for example by continuously placing at least one reinforcement filament (or filler layer) within molten thermoplastic polymer feed material as the thermoplastic polymer feed material is extruded through a die to form the panel (or a part thereof).

A primary role of this kind of filler can be to provide the panel sufficient hardness and/or to decrease the cost price of the panel, and/or to adjust other panel properties. Moreover, this kind of filler will typically also improve the impact strength of the core and of the panel as such. Preferably, and in particular in case an inert filler (e.g. calcium carbonate) is used, the filler content in the composite material of the panel, in particular of a core of the panel (which may be the sole panel layer), is between 30 and 75% by weight of the composite material of the core, more preferably between 50 and 60% by weight of the composite material of the core. Preferably, the polymer content in the composite material of the core is between 25 and 70% by weight of the composite material of the core, more preferably between 40 and 50% by weight of the composite material of the core. As indicated above, the polymer can either be foamed or unfoamed. Additionally or alternatively, preferably at least one filler is used selected from the group consisting of: a salt, a stearate salt, calcium stearate, and zinc stearate. Stearates have the function of a stabilizer, and lead to a more beneficial processing temperature, and counteract decomposition of components of the composite during processing and after processing, which therefore provide long-term stability. Instead of or in addition to a stearate, for example calcium zinc may also be used as stabilizer. The weight content of the stabilizer(s) in the composite will preferably be between 1 and 5%, and more preferably between 1.5 and 4%. Additionally or alternatively, the panel preferably comprises at least one impact modifier comprising at least one alkyl methacrylate, wherein said alkyl methacrylate is preferably chosen from the group consisting of: methyl methacrylate, ethyl methacrylate, propyl methacrylate, isopropyl methacrylate, t-butyl methacrylate and isobutyl methacrylate. The impact modifier typically improves the product performance, in particular the impact resistance. Moreover, the impact modifier typically toughens the core layer and can therefore also be seen as toughening agent, which further reduces the risk of breakage. Often, the modifier also facilitates the production process, for example, as already addressed above, in order to control the formation of the foam with a relatively consistent (constant) foam structure. The weight content of the impact modifier in the composite will preferably be between 1 and 9%, and more preferably between 3 and 6%. At least one plastic material used in the panel is preferably free of any (toxic) plasticizer in order to increase the desired rigidity of the core layer, which is, moreover, also favourable from an environmental point of view. At least one filler applied in the panel may be a virgin filler, a recycled filler, and/or a combination thereof. For example, in case cotton is used as filler, recycled cotton (e.g. derived from recycled jeans or denim) may be used, and/or a combination of recycled cotton or virgin cotton. The panel, a core of the panel and/or another panel layer may comprise wood-based material, for example, MDF, HDF, wood dust, bamboo, prefabricated wood, more particularly so-called engineered wood. This wood-based material may be part of a composite material of the core. Alternatively, the panel and/or the panel core is at least partially composed of another base material, such as a mineral material, like magnesium oxide, magnesium hydroxide, gypsum, (lightweight) concrete, and/or clay; and/or a wood or a wood-based material, such as HDF or MDF, or any other thermoplastic-free material, may be used as base material.

The density of the core typically varies from about 0.1 to 1.5 grams/cm$^3$, preferably from about 0.2 to 1.4 grams/cm$^3$, more preferably from about 0.3 to 1.3 grams/cm$^3$, even more preferably from about 0.4 to 1.2 grams/cm$^3$, even more preferably from about 0.5 to 1.2 grams/cm$^3$, and most preferably from about 0.6 to 1.2 grams/cm$^3$. It is imaginable that each panel comprises a plurality of core (sub)layers. Different core (sub)layers may have either identical compositions or different compositions, and/or different densities.

The invention also relates to a covering at least partially composed of a plurality of interconnected and/or interconnectable panels according to the invention.

The invention further relates to a panel system for composing a floor covering or wall covering, in particular for outdoor use, comprising:

- at least one panel having or comprising a bottom side which comprises at least one bottom groove configured to at least partially accommodate at least one first support structure for supporting said panel, and
- at least one first support structure configured to be partially accommodated within at least one bottom groove of said panel.

The panel system according to the invention, which can be used as outdoor panel system and/or as indoor panel system, comprises one or more panels, each panel having at least one bottom groove at its bottom side, for accommodating at least a part of at least one first support structure. This accommodation leads to a limited movement of the panels with respect to each other and with respect to the first support structure(s), which facilitates the realization of a stable covering, such as a floor covering or wall covering. Further advantages and embodiments of the panel system and its components are presented below.

Preferably at least one bottom groove of at least one panel is a transverse bottom groove, which preferably extends in a direction substantially perpendicular to a longitudinal axis of the panel. Preferably, at least one bottom groove of at least one panel connects (to) opposing panel edges. It is imaginable that one or more bottom grooves present at the bottom side of the panel enclose an angle with a longitudinal axis of the panel. It is imaginable that in case more bottom grooves are present at the bottom side of the panel that at least two of these bottom grooves run parallel and/or that at least two of these bottom grooves mutually enclose an angle, such as an angle between 15 and 165 degrees. It is imaginable that at least two bottom grooves of a panel mutually intersect. This latter provides more flexibility to install the panel onto a first support structure, and in particular provides more freedom on how to orient said panel with respect to said support structure. The installation pattern options can be increased by this latter option.

Each panel is preferably fixated with respect to the first support structure during installation of the panel system. This fixation is preferably such that it can be done easily, preferably without damaging the panel and/or the first support structure to allow a smooth de-installation. The fixation is preferably realized in horizontal direction and/or vertical direction, preferably in both horizontal direction and vertical direction. This fixation is preferably realized without using separate clips and/or other mechanical or chemical fastening means, which may e.g. be realizing by providing the panel(s) and/or first support structure(s) by one or more coupling profiles which allow each panel and each first support structure to be interlocked (coupled). It is however imaginable that separate clips and/or other mechanical and/or chemical fastening means are alternatively or additionally used to realize and/or to improve this mutual fixation.

The bottom groove(s) in of each panel may be elongated and/or may be formed by a cavity, slot, recess, impression, or alternative accommodating space. The bottom groove(s) may be linear and/or curvilinear, and/or may have an alternative shape, such as cross-shaped or square-shaped. Hence, the bottom groove may have different shapes, but is preferably linear, elongated (hence rectangular and oblong) and preferably connects opposing panel edges.

The panel system preferably comprises at least one panel according to the invention, and at least one first support structure configured to be partially accommodated within at least one pair of aligned accommodating spaces and/or bottom groove, preferably transverse bottom groove, applied in the lower side of said panel.

By inserting a part, in particular a top part, of the first support structure into at least one cavity or groove or alternative accommodating space, mutually displacement of the panel(s) and the first support structure during normal use can be counteracted, and/or minimized, and/or even eliminated, being in favour of the stability of the panel and a covering at least partially formed by a plurality of interlocked panels, during normal use.

Preferably, at least one panel at least one third coupling profile, and at least one first support structure comprises at least one fourth coupling profile configured to interlockingly engage with said third coupling profile. This interlocking is preferably such that said panel can be locked with respect to the first support structure in horizontal direction and/or vertical direction, preferably in both directions.

Preferably, at least one accommodating space and/or at least one bottom groove, preferably transverse bottom groove, of at least one panel comprises at least one third coupling profile, and wherein said first support structure comprises at least one fourth coupling profile configured to interlockingly engage with said third coupling profile, in horizontal direction and/or vertical direction. Such an interlocking engagement will further contribute to create a stable floor covering (or wall covering). In a preferred embodiment, the third coupling profile comprises at least one third tongue, preferably a third sideward tongue, and wherein the fourth coupling profile comprises at least one fourth groove configured to receive at least a part of at least one third sideward tongue, wherein said fourth groove is preferably defined by a fourth upper lip and a fourth lower lip. The third coupling profile preferably comprises two facing third sideward tongues which are at least partially positioned in the same plane at a distance from each other, wherein a space enclosed by said two third sideward tongues is configured to accommodate a part of at least one fourth coupling profile. From a cross-sectional view, the sideward tongues and the enclosed space together preferably form a symmetric arrangement. The application of a plurality of opposing, distant, third sideward tongues allow the panels to be mounted onto the support structure(s) in two directions, which makes a pre-alignment between panel and support structure less critical, which facilitates the installation of the system. Preferably, the fourth groove is configured to clamp at least one third sideward tongue. In this manner a horizontal locking effect between the third coupling profile and second coupling profile can be realized. Additionally, or alternatively, the third coupling profile may comprise at least one third locking element, such as a bulge and/or recess, and the fourth coupling profile may comprise at least one fourth locking element, such as a recess and/or bulge, configured to co-act with said third locking element(s) of an adjacent panel. In this manner, an additional locking effect, preferably in horizontal direction (and/or in vertical direction) may be realized. This counteracts undesired uncoupling of the panel(s) with respect to the (first) support structure(s). Preferably, the fourth lower lip is configured to support at least a third sideward tongue. The fourth lower lip may for example be formed by a horizontal plane and/or strip or alternative, optionally more spatial structure, with a supporting upper surface, preferably a horizontal supporting upper surface. The lower side of the third sideward tongue preferably coincides with and/or is formed by (or is forming) the lower side of the panel. The fourth upper lip is provided with at least one upwardly protruding ridge, which, in coupled condition of adjacent panels, is situated in between facing, distant surfaces, preferably chamfered and/or curved surfaces, of at least one third coupling profile. This typically leads to additional locking of the panel with respect to the (first) support structure. Preferably, the upwardly protruding ridge is configured to support the panel. This could reduce the local load and local pressure, which will be in favour of the load capacity of the (first) support structure. Preferably, each third coupling profile and each fourth coupling profile are configured to be coupled by means of a translational movement, preferably by means of a translation movement only, in particular in a (horizontal) direction parallel to the plane defined by the panel.

Preferably, the fourth coupling profile(s) make(s) integral part of the first support structure. This can e.g. be realized by means of extrusion, or alternatively by means of injection-moulding.

The panel system according to the invention preferably comprises a plurality of interlockable or interlocked panels, wherein first coupling profiles of at least one panel are configured to engage interlockingly with second coupling profiles of at least one other panel, such that pairs of aligned accommodating spaces of adjacent panels are aligned with each other and/or such that bottom grooves, preferably transverse bottom grooves, of adjacent panels are aligned with each other to collectively accommodate a part of at least one first support structure. Hence, the first support structure is preferably configured to simultaneously support a plurality of interconnected panels. To this end, it is favourable in case the length of the first support structure(s) is at least n times the panel width, wherein n is at least two and preferably at least five, more preferably at least ten. Preferably, the assembly of interlocked panels comprises third coupling profiles which interlockingly engage with at least one fourth coupling profile of said first support structure. Typically, the panel system comprises a plurality of first support structures. Preferably, a plurality of support structures, which may be first support structures, is oriented at a distance d from each other and in a parallel manner, wherein each first support structure interlockingly engages with a plurality of mutually interlocked panels. Said distance d is preferably at least 40 centimetre and/or preferably less than 150 centimetre. This allows a stable support of the panel for normal use e.g. as walking surface. For more heavy use, for example for transporting vehicles over said covering, the distance d can be reduced to a value below 40 centimetre.

An inversed embodiment is also imaginable, wherein the third coupling profile comprises a groove configured to accommodate at least a part of at least one tongue of the fourth coupling profile. The same applies to the above discussed further embodiments of the third coupling profile and fourth coupling profile.

The first support structure(s) is also referred to as active support structure. Additionally, the panel system preferably comprises at least one second support surface, free of any coupling profiles, configured to merely support at least one panel, preferably a plurality of mutually interlocked panels. Interlocked panels are preferable supported by an assembly of first and second support structures. Second support structures typically do not lock the panels in place and rather have a mere supporting function. The advantage of these second support structures is that the panels do not have to be weakened by accommodating spaces and/or grooves applied in the lower side of the panels at the supporting location of the second support structure, which will be in favour of maintaining the panels as strong and robust as possible. Preferably, the at least one (first and/or second) support structure comprises levelling feet, such as levelling screws, to level the support structure onto a subfloor. In this way the support structures can be mounted onto said subfloor in an entirely horizontal manner, or, if desired, at a slightly inclined manner e.g. to facilitate water drainage. Preferably, the panel system comprises at least one base plate configured to simultaneously support a plurality of levelling feet. In this manner a favourable load distribution of the levelling feet can be realized, which will be in the benefit of the stability of the support structure(s), and hence of the panel system as such.

The invention additionally relates to a first support structure for use in a panel system according to the invention.

The invention moreover relates to a method of composing a covering, in particular a floor covering, by using a panel system according to the invention, comprising the steps of:

A) providing a plurality of panels, wherein each panel is having a bottom side which comprises at least one bottom groove configured to at least partially accommodate at least one first support structure for supporting said panels and/or wherein each panel comprises, preferably at its bottom side, at least one third coupling profile, B) providing a plurality of first support structures, wherein each first support structure preferably comprises at least one fourth coupling profile, C) optionally providing a plurality of second support structures, D) optionally interlocking at least two panels by coupling the first coupling profiles of a panel to the second coupling profiles of an adjacent panel, E) positioning the first support structures onto a subfloor, such as a stabilized sand bed, and optionally positioning the second support structures, if applied, onto said subfloor, and F) positioning the panels onto at least one first support structure, such that the bottom grooves of at least two adjacent panels are aligned, and such that each support structure is partially accommodated within aligned bottom grooves of said adjacent panels, and preferably interlocking the optionally interlocked panels with said first support structure by coupling the third coupling profiles of the panels to the fourth coupling profiles of the first support structures, in particular by sliding the assembly of optionally interlocked panels in a direction parallel to a plane defined by said panels.

Typically, step D) is performed prior to step E), although an inversed order (step E) prior to step D)) is also well imaginable. During step E) the first support structures, and the distance therein between preferably are aligned with the panels to be coupled to said first support structures in order to allow third coupling profiles of the panels to co-act with fourth coupling profiles of the first support structures to lock (fixate) the panels with respect to the first support structure. The method preferably also comprises step G) comprising the step of levelling each support structure with respect to the subfloor, wherein step G) is preferably performed prior to step F).

Further embodiments are described in the non-limitative set of clauses presented below:

Clauses

1. Panel for composing a floor covering or wall covering, comprising:
   a first edge which comprises a plurality of first coupling profiles, and
   a second edge, preferably located opposed to the first edge, which comprises a plurality of second coupling profiles, wherein each second coupling profile is configured to engage interlockingly with at least one first coupling profile of an adjacent panel, both in horizontal direction and in vertical direction,
   wherein said first edge and/or said second edge comprises at least one drainage segment which is free of coupling profiles to facilitate flow-through of water in between the first edge of said panel and a facing second edge of an adjacent panel, in coupled condition of said panels.
2. Panel according to clause 1, wherein at least one drainage segment is enclosed by adjacent coupling profiles.
3. Panel according to any of the preceding clauses, wherein at least one edge of the first edge and second edge comprises at least three coupling profiles, wherein a drainage segment is present in between each pair of adjacent first coupling profiles.
4. Panel according to any of the preceding clauses, wherein at least one drainage segment is substantially delimited by a vertical plane defined by the corresponding edge.
5. Panel according to any of the preceding clauses, the first edge comprises at least one first drainage segment, and wherein the second edge comprises at least one second drainage segment.
6. Panel according to clause 5, wherein at least one first drainage segment is at least partially aligned with at least one second drainage segment, such that said first drainage segment of said panel is facing said second drainage segment of an adjacent panel, in coupled condition of said panels.
7. Panel according to clause 5 or 6, wherein the length of at least one first drainage segment exceeds the length of at least one second drainage segment.
8. Panel according to one of the foregoing clauses, wherein the length of at least one drainage segment exceeds the length of at least one adjacent coupling profile.
9. Panel according to one of the foregoing clauses, wherein the length of at least one coupling profile exceeds the length of at least one adjacent coupling profile.
10. Panel according to any of the foregoing clauses, wherein at least one first coupling profile comprises:
    a sideward tongue extending in a direction substantially parallel to a plane defined by the panel, wherein an upper side of said sideward tongue comprises at least one first locking element, such as an upwardly protruding locking element; and wherein at least one second coupling profile comprises:

a groove configured for accommodating at least a part of the sideward tongue of at least one first coupling profile of an adjacent panel, said groove being defined by an upper lip and a lower lip, wherein said lower lip extends beyond said upper lip, and wherein a lower side of said upper lip comprises at least one second locking element, such as a downwardly facing recess, configured to face, and preferably co-act with, the first locking element of an adjacent panel, in coupled condition of said panels to interlock the panels in horizontal direction.

11. Panel according to clause 10, wherein the first and second coupling profile are configured such that two of such panels can be coupled to each other by means of a turning movement, wherein, in coupled condition: at least a part of the sideward tongue of a first panel is inserted into the groove of an adjacent, second panel, and wherein at least one second locking element of said first panel faces, and preferably co-acts with, the first locking element of said adjacent panel to interlock both panels both in horizontal and vertical direction.

12. Panel according to clause 10 or 11, wherein the lower lip comprises an inner segment, which is positioned directly below the upper lip, and a connecting outer segment, which extends beyond an outer vertical plane defined by the upper lip, wherein the maximum height of the inner segment is identical to or exceeds the maximum height of the outer segment.

13. Panel according to clause 12, wherein an upper surface of the lower lip, preferably the outer segment of the lower lip, comprises at least one upward drainage groove.

14. Panel according to one of clauses 10-13, wherein the lower lip of said panel is configured to engage a stop surface of the second profile of an adjacent panel, in coupled condition of said panels, wherein said stop surface is located at a lower level than the sideward tongue.

15. Panel according to one of clauses 10-14, wherein a lower side of the panel is provided with a longitudinal cut-out portion connecting and parallel to the first edge for accommodating each lower lip in coupled condition of adjacent panels.

16. Panel according to one of clauses 10-15, wherein the first coupling profile comprises a first top portion located above the sideward tongue, wherein said first top portion preferably extends in a substantially vertical direction, and wherein an outer end of the upper lip defines a second top portion, wherein said second top portion preferably extends in a substantially vertical direction, and wherein said second top portion is configured to face the first top portion of an adjacent panel, in coupled condition of said panels, preferably such that the first top portion and the facing second top portion are positioned at a distance from each other.

17. Panel according to one of clauses 10-16, wherein at least one lower lip is provided with at least one curved side edge, preferably two curved side edges.

18. Panel according to one of clauses 10-17, wherein at least one sideward tongue is provided with at least one curved side edge, preferably two curved side edges.

19. Panel according to any of the preceding clauses, wherein at least two first coupling profiles, in particular as seen from a cross-sectional view, are identical.

20. Panel according to any of the preceding clauses, wherein at least two first coupling profiles, in particular as seen from a cross-sectional view, are mutually different.

21. Panel according to any of the preceding clauses, wherein at least two first coupling profiles, in particular as seen from a top view, are mirror symmetric first coupling profiles.

22. Panel according to any of the preceding clauses, wherein at least two second coupling profiles, in particular as seen from a top view, are mirror symmetric second coupling profiles.

23. Panel according to any of the preceding clauses, wherein each pair of at least one pair of adjacent first coupling profiles and at least one pair of opposing adjacent second coupling profiles encloses an accommodating space for accommodating a separate support structure for supporting said panel, wherein accommodating spaces are aligned with each other.

24. Panel according to clause 23, wherein an upper side of each accommodating space is at least partially defined by a curved and/or inclined surface.

25. Panel according to any of the preceding clauses, wherein the lower side of the panel comprises at least one bottom groove, preferably transverse bottom groove, preferably connecting the first edge and the second edge, wherein said bottom groove, preferably transverse bottom groove, is configured to accommodate a separate support structure for supporting said panel, and wherein the bottom groove, preferably transverse bottom groove, is preferably connected and aligned with a pair of opposing, aligned accommodating spaces to form a continuous accommodating groove for accommodating a part of said separate support structure.

26. Panel according to one of clauses 23-25, wherein at least one accommodating space and/or at least one bottom groove, preferably transverse bottom groove, comprises at least one third coupling profile configured to interlockingly engage with at least one fourth coupling profile of said separate support structure, in horizontal direction and/or vertical direction.

27. Panel according to any of the preceding clauses, wherein at least two second coupling profiles, in particular as seen from a cross-sectional view, are identical.

28. Panel according to any of the preceding clauses, wherein at least two second coupling profiles, in particular as seen from a cross-sectional view, are mutually different.

29. Panel according to any of the preceding clauses, wherein the coupling profiles make integral part of the panel, in particular a core of the panel.

30. Panel according to any of the preceding clauses, wherein a second pair of opposing edges, in particular a third edge and fourth edge, of the panel is entirely free of coupling profiles.

31. Panel according to any of the preceding clauses, wherein the panel is a rectangular, preferably oblong, panel.

32. Panel according to any of the preceding clauses, wherein the panel is at least partially an extruded panel, and preferably an entirely extruded panel, more preferably an entirely co-extruded panel.

33. Panel according to any of the preceding clauses, wherein the panel is a monolithic panel.

34. Panel according to any of the preceding clauses, wherein the panel is a multi-layered panel, preferably a co-extruded multi-layered panel, which comprises a core layer and a top structure, directly or indirectly, affixed to said core layer.
35. Panel according to any of the preceding clauses, wherein the panel is a hollow panel, which preferably encloses at least one internal, preferably linear, channel connecting a third edge and a fourth edge, wherein said internal channel is preferably located at a distance from both the lower side of the panel and the upper side of the panel, and wherein each of the third edge and fourth edge preferably connects the first edge and the second edge.
36. Panel according to any of the preceding clauses, wherein the panel is at least partially composed of at least one polymer material, preferably a thermoplastic material, wherein said polymer material is preferably enriched with at least one filler, more preferably chosen from the group consisting of: wood chips, wood dust, wood fibre, hemp fibre, bamboo, cotton, coffee, glass fibre, and mineral fillers, such as talc, chalk, limestone (calcium carbonate), and marble dust.
37. Panel according to clause 36, wherein said thermoplastic material is chosen from the group consisting of: PVC, PET, PP, PS, thermoplastic polyurethane (TPU), PE, in particular MDPE and/or HDPE; and combinations thereof.
38. Panel according to any of the preceding clauses, wherein the panel is a water-resistant panel.
39. Panel according to any of the preceding clauses, wherein the panel is an outdoor decking panel.
40. Panel according to any of the preceding clauses, wherein the panel is a substantially rigid panel.
41. Panel according to any of the preceding clauses, wherein the length of the panel is situated in between 1 and 4 meter, preferably between 1.5 and 4 meter, more preferably between 3 and 4 meter.
42. Panel according to any of the preceding clauses, wherein the thickness of the panel is situated in between 3 and 40 millimetre, preferably between 8 and 35 millimetre, more preferably between 10 and 30 millimetre.
43. Panel according to any of the preceding clauses, wherein the panel comprises a visible printed top surface, which printed top surface is preferably at least partially covered by at least one transparent and/or translucent layer.
44. Panel according to any of the preceding clauses, wherein the upper side of the panel has a relief structure.
45. Panel according to clause 44, wherein the relief structure is an extruded relief structure and/or a pressed relief structure and/or a printed relief structure.
46. Panel according to clause 44 or 45, wherein the relief structure comprises a plurality of parallel oriented elongated excavations connecting opposing panel edges, such as the third edge and the fourth edge, and/or the first and the second edge.
47. Panel according to one of clauses 44-46, wherein the depth of at least one excavation increases towards at least one connecting panel edge.
48. Panel according to clause 47, wherein the depth of at least one excavation that increases from a central portion of the upper surface towards at least one connecting panel edge.
49. Panel according to one of clauses 44-48, wherein the excavations have a maximum depth greater than 0.5 millimetre.
50. Panel according to one of clauses 44-49, wherein the relief structure comprises a wood pattern, a stone pattern, a cement pattern, or an image pattern.
51. Panel according to any of the preceding clauses, wherein the lower side of the panel comprises a lower relief structure.
52. Panel according to any of the preceding clauses, wherein the panel is a co-extruded multi-layer panel, and wherein the panel a hollow panel which encloses at least one internal, preferably linear, channel, which channel preferably connects a third edge and a fourth edge, and wherein a circumferential wall of said at least one internal channel is partially formed one layer and partially formed by at least one other layer of the multi-layer panel, and wherein at least one of said layers defining the circumferential wall of said at least one internal channel preferably has a flat side facing said at least one internal channel.
53. Covering composed of a plurality of interconnected panels according to any of the preceding clauses.
54. Panel system for composing a floor covering or wall covering, in particular for outdoor use, comprising:
at least one panel according to any of clauses 23-26, and
at least one first support structure configured to be partially accommodated within at least one pair of aligned accommodating spaces and/or bottom groove, preferably transverse bottom groove, applied in the lower side of said panel.
55. Panel system according to clause 54, wherein at least one accommodating space and/or at least one bottom groove, preferably transverse bottom groove, of at least one panel comprises at least one third coupling profile, and wherein said first support structure comprises at least one fourth coupling profile configured to interlockingly engage with said third coupling profile, in horizontal direction and/or vertical direction.
56. Panel system according to clause 55, wherein the third coupling profile comprises at least one third sideward tongue, and wherein the fourth coupling profile comprises at least one fourth groove configured to receive at least a part of the third sideward tongue, wherein said fourth groove is defined by a fourth upper lip and a fourth lower lip.
57. Panel system according to clause 56, wherein the third coupling profile comprises two facing third sideward tongues which are at least partially positioned in the same plane at a distance from each other, wherein a space enclosed by said two third sideward tongues is configured to accommodate a part of at least one fourth coupling profile.
58. Panel system according to clause 56 or 57, wherein the fourth groove is configured to clamp at least one third sideward tongue.
59. Panel system according to any of clauses 56-58, wherein the fourth lower lip is configured to support at least third sideward tongue.
60. Panel system according to any of clauses 56-59, wherein the lower side of the third sideward tongue coincides with the lower side of the panel.
61. Panel system according to any of clauses 56-60, wherein the fourth upper lip is provided with at least one upwardly protruding ridge, which, in coupled condition of adjacent panels, is situated in between facing, distant chamfered surfaces of at least one third coupling profile.

62. Panel system according to clause 61, wherein the upwardly protruding ridge is configured to support the panel.

63. Panel system according to any of clauses 56-62, wherein each third coupling profile and each fourth coupling profile are configured to be coupled by means of a translational movement, preferably by means of a translation movement only, in particular in a direction parallel to the plane defined by the panel.

64. Panel system according to any of clauses 53-63, wherein the panel system comprises a plurality of interlockable or interlocked panels, wherein first coupling profiles of at least one panel are configured to engage interlockingly with second coupling profiles of at least one other panel, such that pairs of aligned accommodating spaces of adjacent panels are aligned with each other and/or such that bottom grooves, preferably transverse bottom grooves, of adjacent panels are aligned with each other to collectively accommodate a part of at least one first support structure.

65. Panel system according to clause 64, wherein the assembly of interlocked panels comprises third coupling profiles which interlockingly engage with at least one fourth coupling profile of said first support structure.

66. Panel system according to any of clauses 53-65, wherein the panel system comprises a plurality of first support structures.

67. Panel system according to clause 66, wherein a plurality of first support surface is oriented at a distance from each other and in a parallel manner, wherein each first support structure interlockingly engages with a plurality of mutually interlocked panels.

68. Panel system according to any of clauses 53-67, wherein the panel system comprises at least one second support surface, free of any coupling profiles, configured to merely support at least one panel, preferably a plurality of mutually interlocked panels.

69. Panel system according to any of clauses 53-68, wherein at least one support structure comprises levelling feet, such as levelling screws, to level the support structure onto a subfloor.

70. Panel system according to clause 69, wherein the panel system comprises at least one base plate configured to simultaneously support a plurality of levelling feet.

71. Method of composing a covering, in particular a floor covering, by using a panel system according to any of clauses 53-70, comprising the steps of:

A) providing a plurality of panels,

B) providing a plurality of first support structures,

C) optionally providing a plurality of second support structures,

D) interlocking at least two panels by coupling the first coupling profiles of a panel to the second coupling profiles of an adjacent panel, E) positioning the first support structures onto a subfloor, such as a stabilized sand bed, and optionally positioning the second support structures, if applied, onto said subfloor, and F) interlocking the interlocked panels with said first support structure by coupling the third coupling profiles of the panels to the fourth coupling profiles of the first support structures, in particular by sliding the assembly of interlocked panels in a direction parallel to a plane defined by said panels.

72. Method according to clause 71, wherein the method comprises step G) comprising the step of levelling each support structure with respect to the subfloor, wherein step G) is performed prior to step F).

BRIEF DESCRIPTION OF THE DRAWINGS

The present invention will hereinafter be further elucidated on the basis of the following non-limitative figures, wherein.

DESCRIPTION OF THE INVENTION

Figure 1:
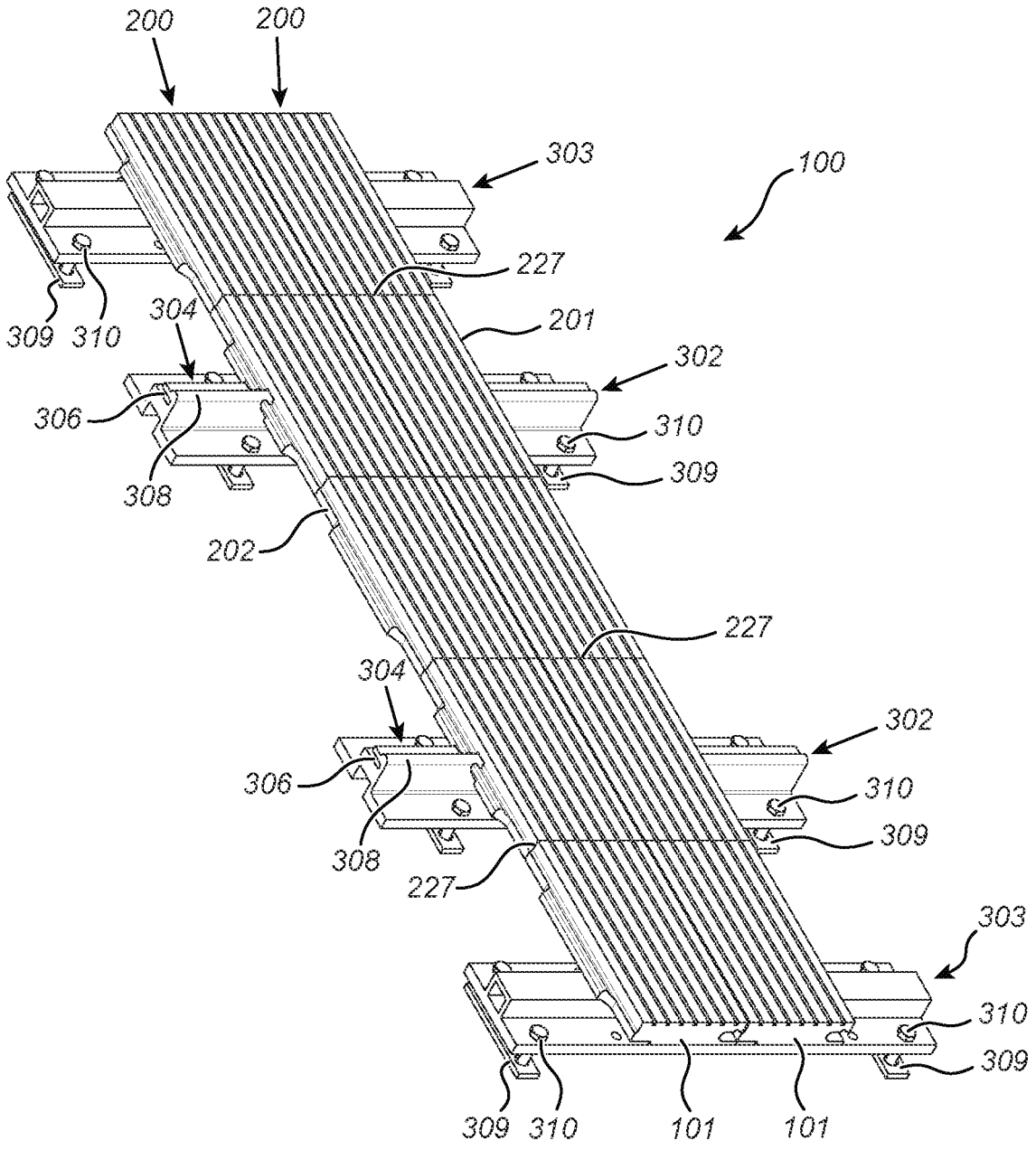
FIG. 1 shows a perspective view of according to a first embodiment of the panel system according to the invention.

FIG. 1 shows a perspective view according to a first non-limitative embodiment of the panel system 100 according to the present invention. The panel system 100 comprises, in this non-limitative example, two panels 101, 200 according to the invention. Said panels 101, 200, rest on support structures 302, 303 according to the present invention. Said panels 101, 200 and the support structures 302, 303 will be elaborated in more detail based on FIGS. 3*a*-3*d*, FIG. 5, and FIGS. 6*a*-6*b*. The panel system 100 composes a floor covering or wall covering. The support structures 302, 303 may as such be arranged for providing support to or carrying the panels 101, 200. In this respect, it may be beneficial to provide for one or more base plates 309. Said base plates 309 may be arranged on a surface which is to be provided with a panel covering according to the invention. However, it should be understood that installation without said base plates 309 is also possible. The base plates 309 may provide support to one or more levelling feet 310. In respect of this particular figure, each base plate 309 supports two levelling feet 310, it is however conceivable that more or fewer levelling feet are supported by the base plates 309. The levelling feet may allow the support structures 302, 303 to be levelled to a preferred extent by the user. As such, the covering may be adjusted to be substantially levelled, or in fact at a slight angle for increasing the drainage. Two types of support structures 302, 303 are provided, a first support structure 302, and a second support structure 303. Said first support structure 302 comprises a coupling profile 304, which may be referred to as a fourth coupling profile 304. The fourth coupling profile 304 may be configured to co-act, that is to interlockingly engage with a third coupling profile 221 of a panel 101. The fourth coupling profile 304 comprises at least one fourth groove 305, which is configured to receive a part of the third coupling profile 221 of a panel 101, 200. The fourth coupling profile 304 may as such be at least partially defined by a fourth upper lip 306 and a fourth lower lip 307. Said fourth lower lip 307 may be configured for supporting at least a part of a panel 101, 200. The first support structure 302 may further comprise an upwardly protruding ridge 308. In a coupled condition of the panels 101, 200, the upwardly protruding ridge 308 may be situated between mutually facing edges 226 of a third coupling profile 221. The second support structures 303 are preferably free of any coupling profile, and may comprise a supporting surface 311, which may be configured to support a bottom side of a panel 101, 200 according to the invention. Said second support structures 303 are in particularly suitable at a begin and end portion of a panel 101, 200. The length of the panels 101, 200 according to the present invention may be situated between 1 and 4 meters, preferably between 1.5 and 4 meter, more preferably between 3 and 4 meters. Optionally, and as shown in this embodiment, one or more fake grouts and/or bevels 227 may be provided on a panel 101, 200. Said fake grouts and/or bevels 227 may optically give the impression the single panel 101, 200 is composed out of a number of panels. It is however noted that the fake grouts and/or bevels 227 may also be omitted from the panel 101, 200.

Figure 2:
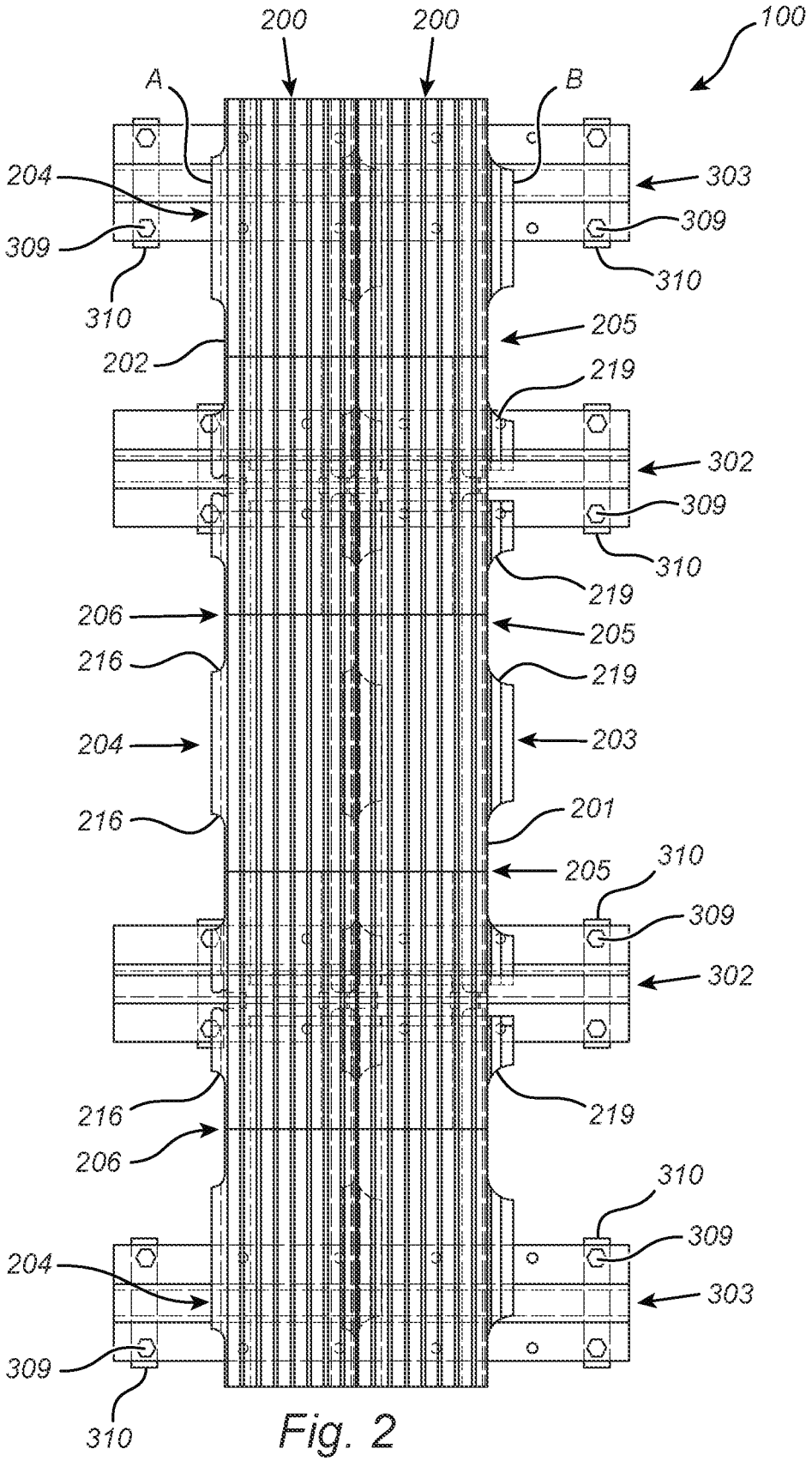
FIG. 2 shows a top view of the panels system shown in FIG. 1.

FIG. 2 shows a top view of the panel system as shown in FIG. 1. The figure indicates that according to this particular embodiment, the first support structure 302 and the second support structure 303 oriented substantially perpendicular with respect to the length direction of the panels 101, 200. It may however be conceivable, or in some instances preferred, to arrange said support structures 302, 303 at an acute or oblong angle with respect to the length direction of the panels 101, 200. It furthermore shows that the length of the different first support structures 302 and second support structures 303 may be different. Also the multiple base plates 309, which may rest on a surface to be provided with a panel covering, may be positioned on different positions in the width direction with respect to each other. Hence, also the levelling feet 310, such as the screws 310 are in different positions, which may provide for more flexibility in adjusting the panel system 100. Moreover, this may allow to provide for sufficient support over substantially the entire panel system since it may allow for more contact points between the surface to be provided with a panel covering and the support structures 302, 303. The top view perspective of the panel system 100 according to the present invention provides a better overview of the first edge 202 and second edge 201 of the panel 101, 200 according to the invention. The first panel edge 202 is provided with a number of first coupling profiles 204. Similarly, the second panel edge 201 is provided with a plurality of second coupling profiles 203. At least one portion of the first edge 202 or second edge 201 is preferably free of coupling profiles 203, 204, and comprises a drainage segment 205, 260. Adjacent coupling profiles 203, 204, may preferably enclose one or more drainage segments 205, 206. Said drainage segments 205, 206 allow water to be washed away from the upper, visible, surface 230 of the panel system 100 according to the invention. This may as such prevent pools of water (or other liquids) from forming on the upper surface. The first coupling profiles 204 and second coupling profiles 203 may mutually be of different lengths, such as denoted by the first coupling profile A, and second coupling profile B in this figure. Coupling profile A is larger compared to profile B. According to this non-limitative embodiment, a drainage segment 205, 206, is provided between each of the adjacent first coupling profiles 204 and each of the adjacent second coupling profiles 203. The drainage segments arranged on the first edge 202 may be referred to as first drainage segments 206, and the drainage segments arranged on the second edge 201 may be referred to as second drainage segments 205. This may allow for a high drainage of water (or other liquids). As noted above, it may be possible that a first coupling profile 204 is larger or smaller compared to a second coupling profile 203. In this respect however, it is preferred that at least one first drainage segment 206 is at least partially aligned with at least one second drainage segment 205, such that said first drainage segment 206 of said panel 101, 200, is facing said second drainage segment 205 of an adjacent panel 101, 200, in coupled condition of said panels 101, 200. It is also imaginable that a first drainage segment 206 exceeds the length of a second drainage segment 205. However, the inverse thereof is also imaginable. Yet, also one drainage segment 205, 206 may exceed the length of a coupling profile 203, 204. In order to further enhance the drainage properties of the one or more drainage segments 205, 206, a side edge of at least one coupling profile of the first coupling profile 204 and/or second coupling profile 203 may be provided with a curved side edge 216, 219, in particular as can be seen from this top view perspective.

Figure 3A:
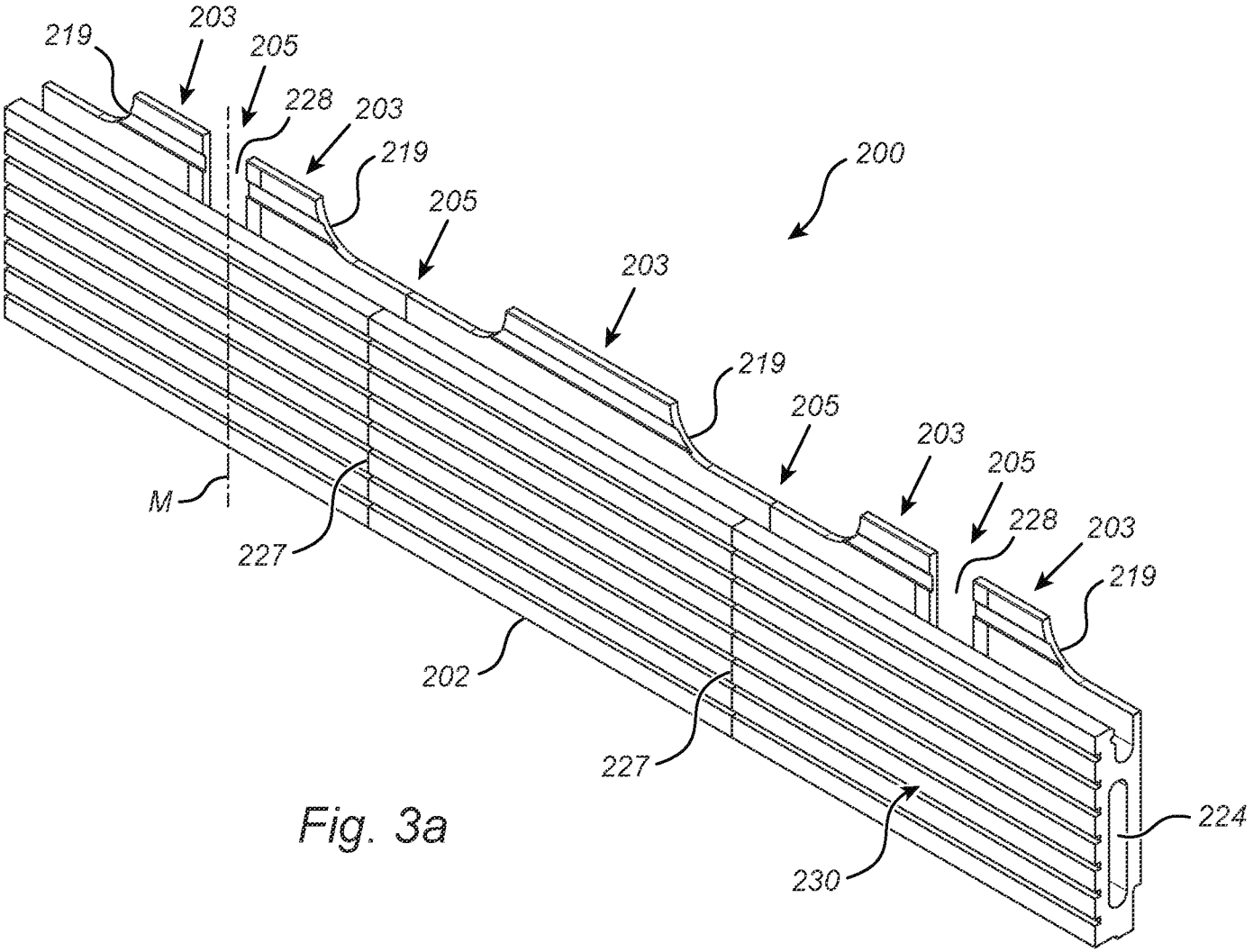
FIGS. 3*a*-3*d* show different views of the panel according to the invention according to an embodiment.
Figure 3B:
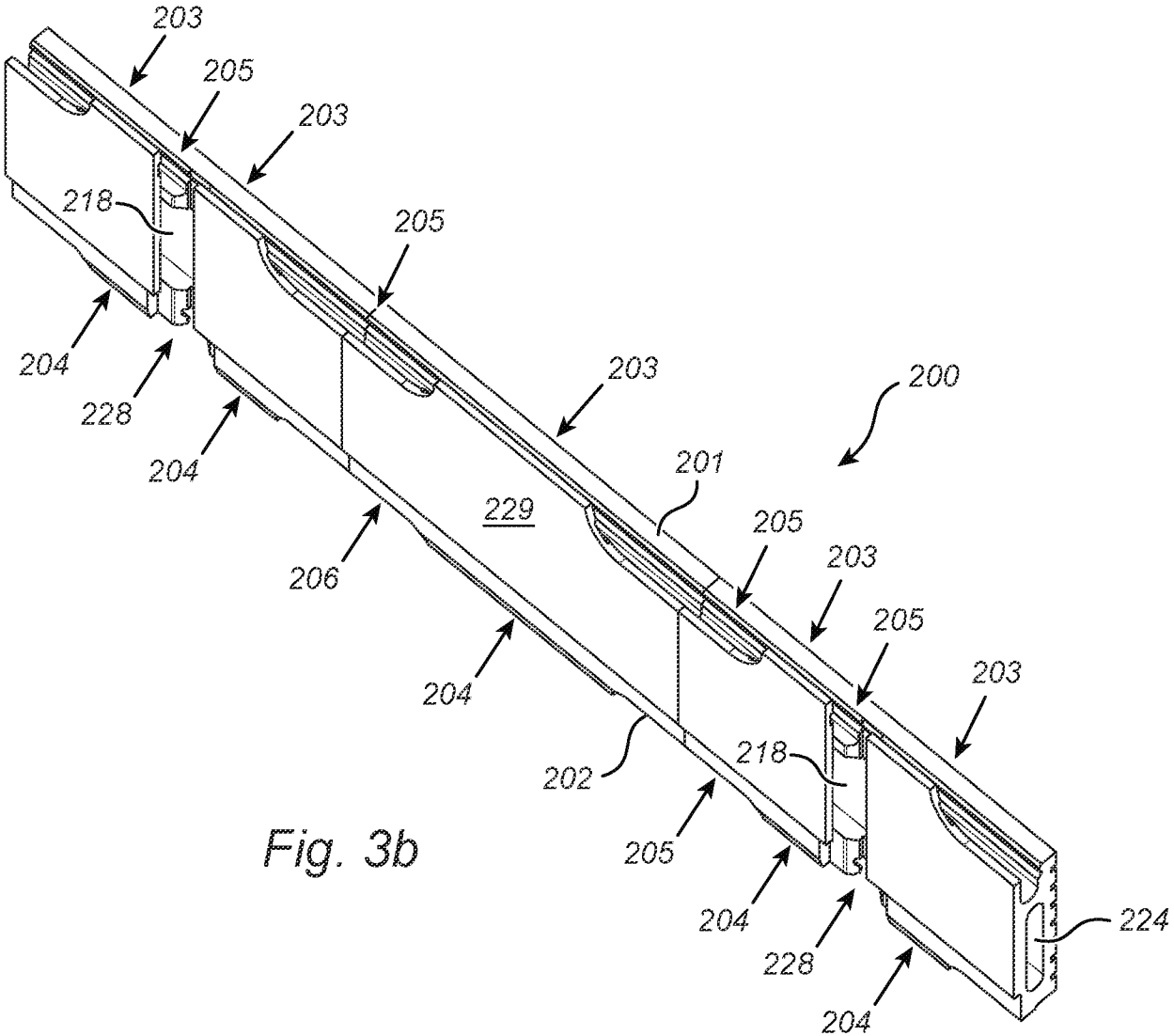
Figure 3C:
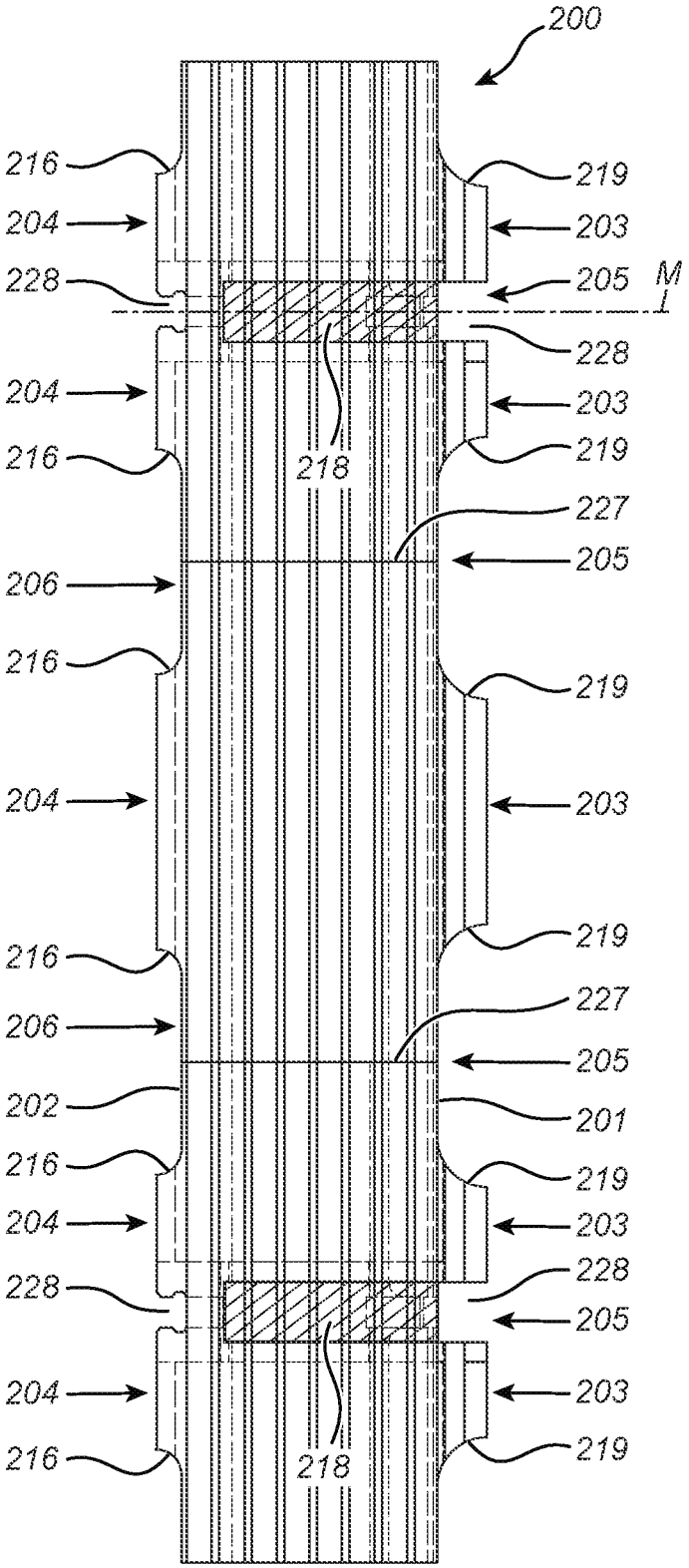
Figure 3D:
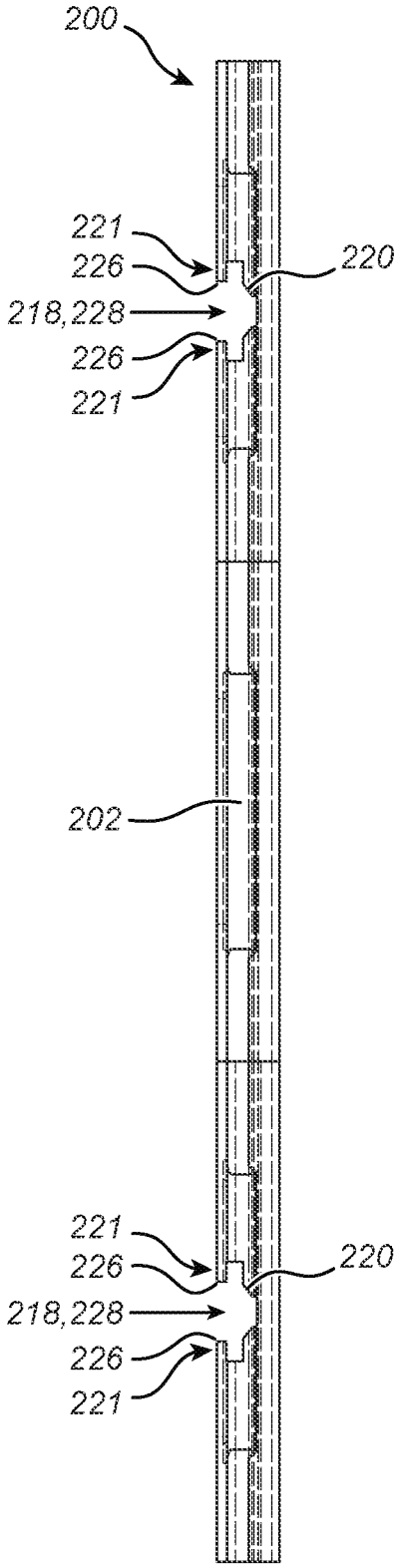

In respect of FIGS. 3*a*-3*d* different aspect of the panel 200 as such will be discussed in more detail. In these figures, FIG. 3*a* shows a perspective view of a panel according to the invention, showing an upper side of the panel 200. FIG. 3*b* also shows a perspective view of the panel 200, but showing a bottom side of the panel 200. FIG. 3*c* shows a top view perspective of the panel 200, and FIG. 3*d* provides a side view of the panel 200 according to the invention. Starting with FIG. 3*a*, the second panel edge 201 can be seen in some amount of detail. A plurality of second coupling profiles 203 are arranged on the second panel edge 201. At least two adjacent coupling profiles 203 are arranged in a mirror symmetric manner, as can be seen by the indicative mirror line M. Said mirror symmetric second coupling profiles 203 mutually enclose a drainage segment 205. Mutually facing edges of said mirror symmetric second coupling profiles 203 are substantially straight, whereas the side edges 219 of said mirror symmetric second coupling profiles 203 that are facing away are curved 219. The curved side edges 219 of the second coupling profiles 203 may allow for a smoother drainage of water (or other liquid). As shown from the bottom end of the panel 200 the panel is in particular hollow, which may be achieved via at least one internal channel 224. Said internal channel 224 may extend through substantially the entire panel 200. Said internal channel 224 may debouch in and/or mutually connect an accommodating space 228 (see also FIGS. 3*b* and 3*d*) and/or bottom groove, preferably transverse bottom groove, 218. Clear distinction should however be made between the accommodating space 218 and the bottom groove, preferably transverse bottom groove, 218. That is, an accommodating space 228 may be defined, as shown in FIG. 3*a*, by a pair adjacent second coupling profiles 203 (but also by a pair of first coupling profiles 204, FIG. 3*b*). Preferably, accommodating spaces 228 defined by a pair of adjacent first coupling profiles 204 and a pair of adjacent second coupling profiles 203 may in coupled condition of two panels 200 at least partially coincide, or overlap or align. The bottom groove, preferably transverse bottom groove, 218 as such is situated in a central part of a panel 200, as can best be seen in FIG. 3*b*. The bottom groove, preferably transverse bottom groove, 218 preferably aligns with at least one, preferably each accommodating space 228. If the bottom groove, preferably transverse bottom groove, 218 is aligned with both accommodating spaces, a continuous accommodating groove may be formed, which essentially stretches the entire width of a panel 200. FIG. 2*b* shows the bottom surface 229 of the panel 200 according to the invention. This figure moreover shows that this particular panel comprises two bottom grooves, preferably transverse bottom grooves, 218, provided at a mutual distance from each other. In this particular embodiment, each of these bottom grooves, preferably transverse bottom grooves, 218 is aligned with a first accommodating space 228, defined by a pair of adjacent first coupling profiles 204, and with a second accommodating space 227, defined by a pair of adjacent second coupling profiles 203. As such, two continuous accommodating groves 218, 228 are formed. These two continuous accommodating grooves 218, 228 allow for at least partially accommodating a part of a first support structure 302 and/or at least a part of a second support structure 303, but most preferably a part of a first support structure 302. FIGS. 3*c* and 3*d* provide for a top view and side view of the panel 200 respectively. In FIG. 3*c*, the accommodating spaces 228 and the bottom grooves, preferably transverse bottom grooves, 218 have also been indicated. FIG. 3*d* shows the continuous bottom groove, preferably transverse bottom groove, 218, 228. The top view shown in FIG. 3*c* also shows the fake grouts or bevels 227, two in this non limitative panel 200. What is also indicated in the figure, is that the accommodating space 228 coincides at least partially with the drainage segments 205, at least seen from a top view. It may also be observed that the first coupling profile 204 and the second coupling profile 203 respectively protrude with respect to the first panel edge 202 and second panel edge 201. The third coupling profiles 221, as shown in FIG. 3*d*, stretch in a direction substantially perpendicular to the length of the panel 200. The third coupling profile 221 is at least formed by at least one accommodating space 228 and/or at least one bottom groove, preferably transverse bottom groove, 218. Or, in other words, at least one accommodating space 228 and/or at least one bottom groove, preferably transverse bottom groove, 218 comprises at least one third coupling profile 221. The third coupling profile 221 may be configured to engage with at least one fourth coupling profile 304 of a separate support structure 302, 303, for locking at least in horizontal direction and/or vertical direction. To this end, the third coupling profile 221 may comprise at least one sideward tongue 226, configured to be at least partially accommodated in a groove 305 of the fourth coupling profile 304. It is also imaginable that the third coupling profile 221 comprises two opposing sideward tongues 226, preferably mutually facing. Preferably, a space enclosed by said two third sideward tongues 226 is configured to accommodate a part of at least one fourth coupling profile 304. A downward facing side of the third coupling profiles 221 is provided with a chamfered surface, which may be configured for resting on at least a part of the upwardly protruding ridge 308 of the fourth coupling profile 304.

Figure 4:
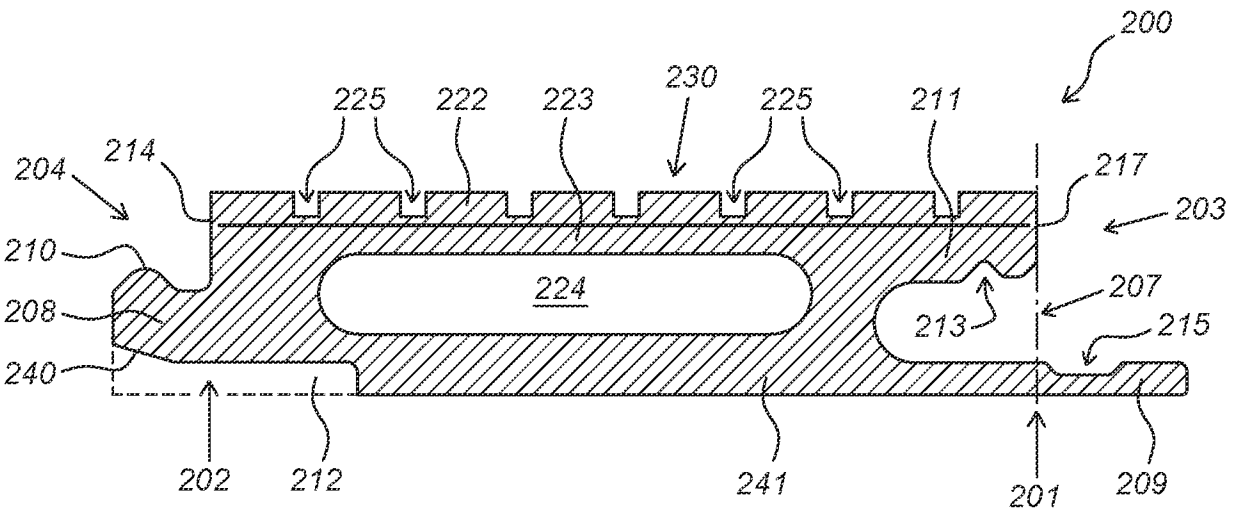
FIG. 4 shows a side view of a single panel according to the invention.

FIG. 4 shows a cross section of a single panel 200 according to the present invention. This figure allows for a more detailed elaboration on the first coupling profile 204 and the second coupling profile 203. At least one of the first coupling profiles 204 comprises a sideward tongue 208. An upper side, or upwardly facing surface of said sideward tongue 208 comprises at least one first locking element 210. In this particular embodiment, said first locking element 210 is formed by an upwardly facing bulge 210. Preferably, said first locking element 210 stretches beyond the average surface height of the sideward tongue 208. As such, said first locking element may function as a horizontal locking element. A lower side of the panel 200 is provided with a cut-out portion 212, which cut-out portion according to this embodiment is connecting to and parallel to the first edge 202. Said cut-out portion is provided for allowing said first edge 202 to accommodate a portion of the second coupling profile 203, in particular a lower lip 209 thereof. A downwardly facing surface of the sideward tongue 208 may be provided with a chamfer 240. Said chamfer 240 may allow the panel to be angled downwardly into the second coupling profile 203 of an adjacent panel 200. This may ease the coupling process of adjacent panels 200. The second coupling profile 203 comprises a groove 207 for accommodating at least a portion of the sideward tongue 208 of a first coupling profile 204. The groove 207 is at least partially defined by a lower lip 209 and an upper lip 211. Said lower lip 209 may be accommodated by a cut-out portion 212 in a coupled condition of adjacent panels 200. In this particular embodiment, a downward facing surface of the upper lip 211 is provided with a second locking element 213. In this embodiment, said second locking element 213 may be formed by a recess 213. Said second locking element configured to receive at least a portion of the first locking element 210, wherein said first locking element 210 and second locking element 213 mutually lock adjacent panels 200. At least one lower lip 209 may be provided with a recessed portion 215, which may function as a drainage channel. It is also conceivable that said recessed portion 215 may be used for providing a screw through the lower lip 209. This may be of benefit in case the lower lip 209, and as such the panel 101, 200, is attached to a mounting structure and/or support structure. In this latter application, the recessed portion 215 may accommodate a head of a screw, such that the screw does not protrude with an upward facing surface of the lower lip 209. Said aforementioned screws may e.g., be placed about every other meter, however the invention is not limited thereto. An upper surface 230 of the panel 200 may be provided with a relief structure 225, which relief structure may comprise a plurality of excavations 225. Said excavations 225 may stretch over substantially the entire length of the panel 200 as such, or may stretch over a part thereof. Although it is conceivable that said excavations 225 are substantially horizontal, it is also conceivable that a first end of the excavations 225 is lower compared to an opposed second end of the excavations 225. Furthermore, at least one through hole may optionally be provided in at least one of the excavations, for allowing water to drain through said hole. In this respect, the hole may extent through the entire panel 200. A central portion of the panel 200 may be substantially hollow 224. This may reduce the weight of the panel, which may reduce costs in terms of material and shipping. The panel 200 may comprise a core portion 241. In this respect, at least one first coupling profile 204 and at least one second coupling profile 203 make integral part of said core 241. The core 241 may at least partially be composed out of thermoplastic material, said thermoplastic material is chosen from the group consisting of: PVC, PET, PP, PS, thermoplastic polyurethane (TPU), PE, in particular MDPE and/or HDPE; and combinations thereof. The panel may optionally comprise a top structure 222, wherein said top structure 222 is preferably co-extruded with said core 241. Hence said top structure 222 is, directly or indirectly, affixed to the core 241. It is imaginable that each of the first coupling profile 204 and second coupling profile 203 comprise a first top portion 214 and second top portion 217 respectively. Said first top portion 214 and second top portion 217 are preferably extending in a vertical direction. The first top portion 214 is located above the sideward tongue 208 of the first coupling profile 204. The second top portion 217 may be at least partially, preferably entirely, formed by an outer end of the upper lip 211. When adjacent panels are mutually coupled, facing top portions 214, 217 are preferably situated at a distance from each other. As such, the gap between said top portions 214, 217 may function as drainage.

Figure 5:
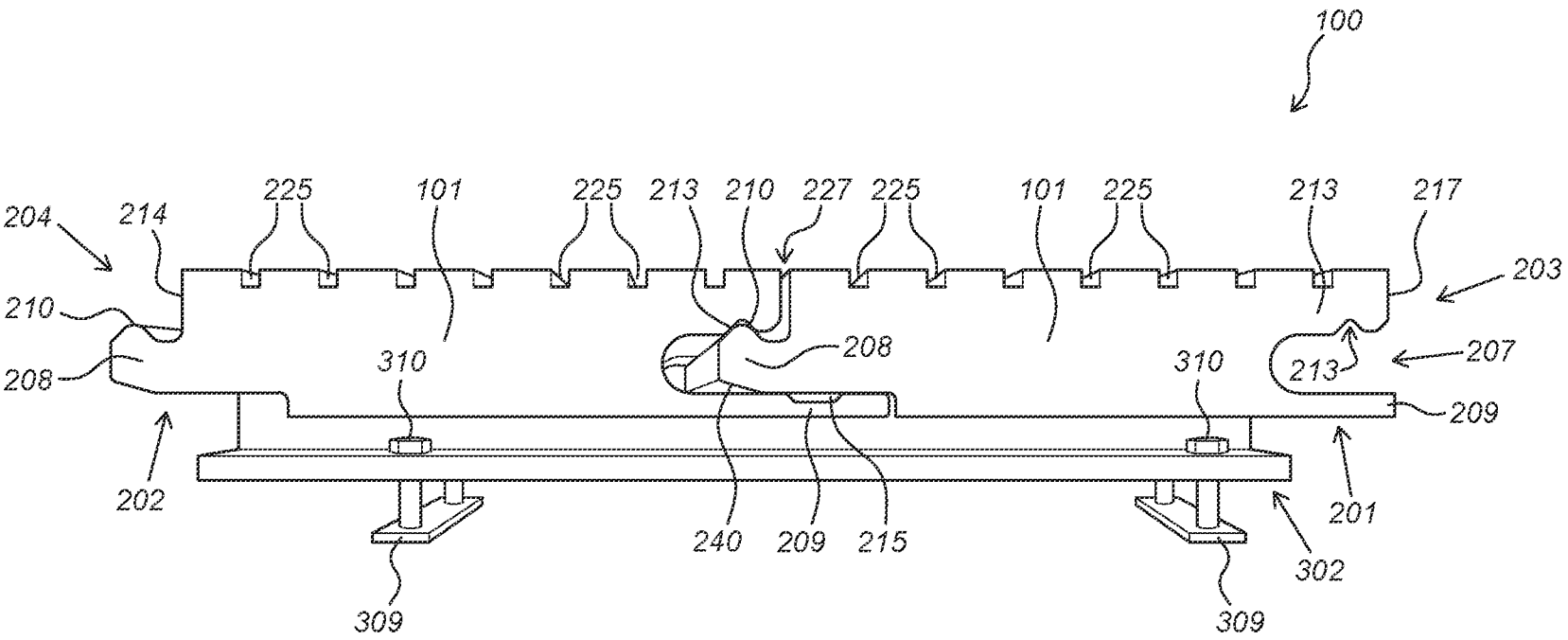
FIG. 5 shows a side view of the panel system according to the present invention.

FIG. 5 shows a side perspective view of the panel system 100 according to the present invention. The figure shows two panels 101, 200, in a mutually coupled condition. As can be seen from the figure, the sideward tongue 208 of a first coupling profile 204 of a first panel is at least partially received by a groove 207 of a second coupling profile 203 of a second adjacent panel 200. The first locking element 210 is accommodated partially in the second locking element 213, which mutually locks the two adjacent panels 200 in a horizontal and/or vertical direction with respect to each other. In order to prevent friction between the first coupling profile 204 and second coupling profile 203 during the locking operation, the sideward tongue 208 is provided with a chamfer 240 on a bottom end portion thereof. The sideward tongue 208 of a first panel may be moved, at a downwardly oriented angle, towards the groove 207 of the second locking profile 203 of an adjacent second panel. Once the sideward tongue 208 of said first panel is maximally inserted into the groove 207 of the adjacent second panel, the first panel may be rotated downwardly into a more horizontal position. This may allow the first locking element 210 to engage with the second locking element 213 and establish an interlockingly connection between the first panel and the second panel. Once said mutually coupled condition is established, the first top portion 214 of the second panel and the second top portion 217 of the first panel may be situated at a mutual distance 227. Said mutual distance 217 between adjacent edges of coupled panels may allow for increased drainage of water (or other liquids). The figure further shows the panels 101, 200, are oriented orthogonally with respect to the support structure 302, 303. The support structure 302, 303 as such being provided with levelling feet 310. Said levelling feet 310 are resting on a base plate 309. Said base plate 309 may increase the weight distribution of the panel system 100. That is, it may distribute the pressure caused by the weight of the panels 101, 200 and the support structure 302, 303 better as compared to the ends of the levelling feet 310.

Figure 6A:
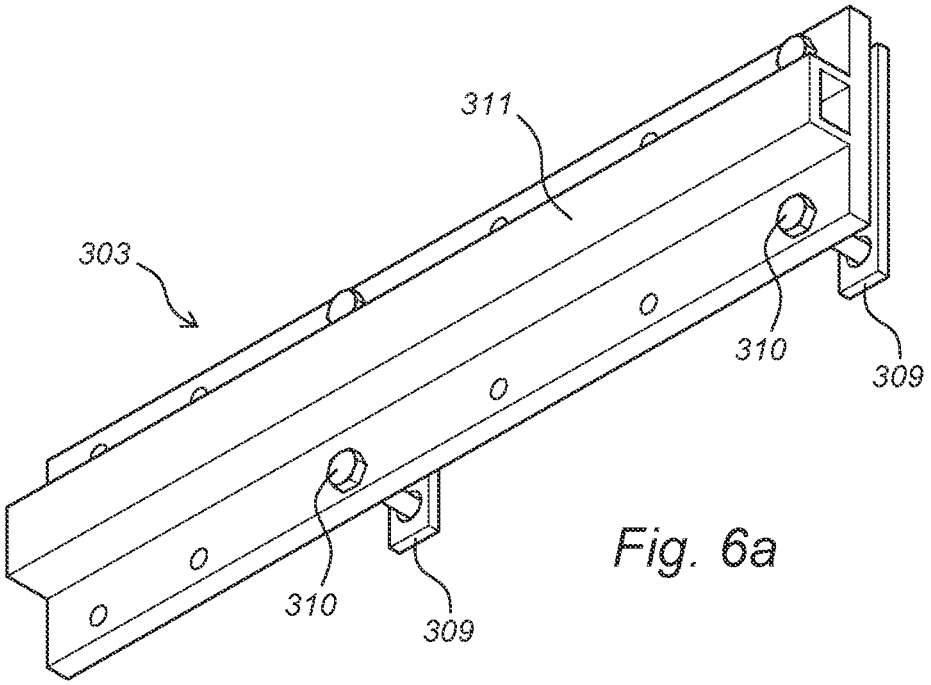
FIGS. 6*a* and 6*b* show perspective views of parts of the support structure for a panel system according to the invention.
Figure 6B:
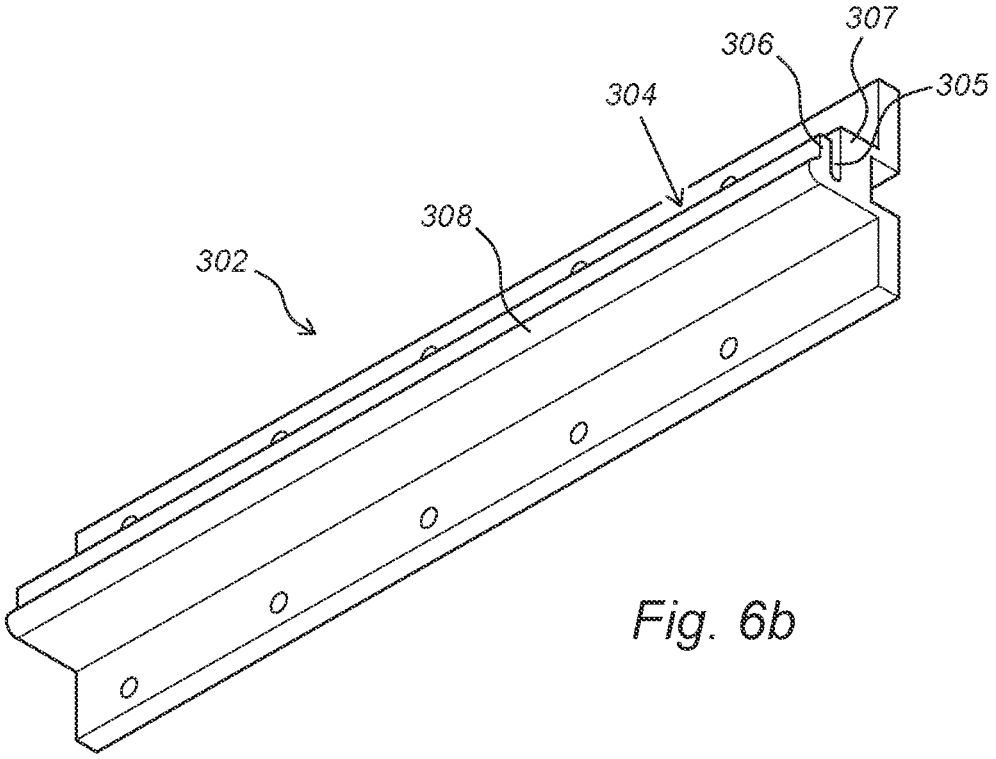

FIGS. 6*a* and 6*b* respectively show a second support structure 303 and a first support structure 302 according to the present invention. According to FIG. 6*a*, the support structure 303 as such is provided with two pairs of levelling feet 310. Said levelling feet 310 are resting on two base plates 309. Said base plates 309 may increase the weight distribution of the panel system 100. That is, it may allow for a better distribution of the pressure caused by the weight of panels 101, 200 resting on said second support structure 303, and the weight of the second support structure 303 itself as compared to the ends of the levelling feet 310. The first support structure 302 is shown without levelling feet 310 and/or base plates 309, it should however be understood that these may also be applied to the first support structure 302. The first support structure 302 comprises a fourth coupling profile 304. The fourth coupling profile 304 being configured for interlockingly engaging with a third coupling profile 221, in horizontal and/or vertical direction. Preferably, the third coupling profile 221 may be coupled to a fourth coupling profile 304 by means of a sliding or translational movement of a panel, preferably a horizontal sliding or translational movement. Said fourth coupling profile 304 is in this non-limitative embodiment formed by a single fourth groove 305. However, variants thereof may also be conceivable. According to FIG. 6*b*, the fourth groove 305 faces in one direction, but alternatives wherein two or more fourth grooves 305 are present should not be excluded by the present invention. When two fourth grooves 305 are applied, said two fourth grooves 305 are preferably facing in opposing outward directions. The fourth groove 305 may be defined by a fourth upper lip 306 and a fourth lower lip 307. The first support structure 302 further comprises at least one upwardly protruding ridge 308. Said ridge 308 is in coupled condition of adjacent panels situated between facing distant, and preferably chamfered, surfaces 226 of at least one third coupling profile 221. Preferably, said first support structure 302 and second support structure 303 are extruded profiles. Optionally, some additional processing steps may be involved, such as providing holes for the levelling feet 310.

Figure 7A:
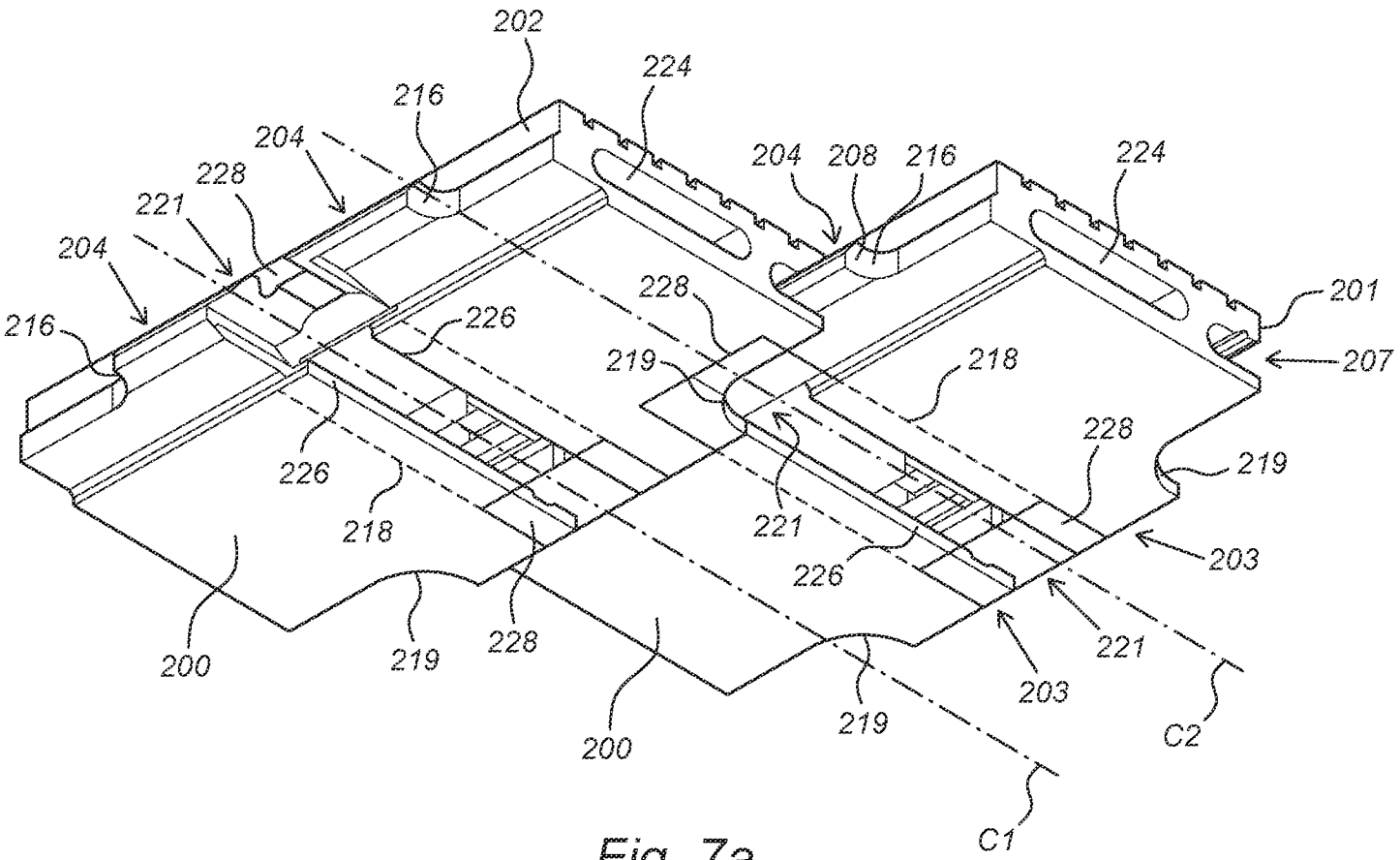
FIGS. 7*a* and 7*b* show two different perspective views of panels according to the invention in different coupled conditions.
Figure 7B:
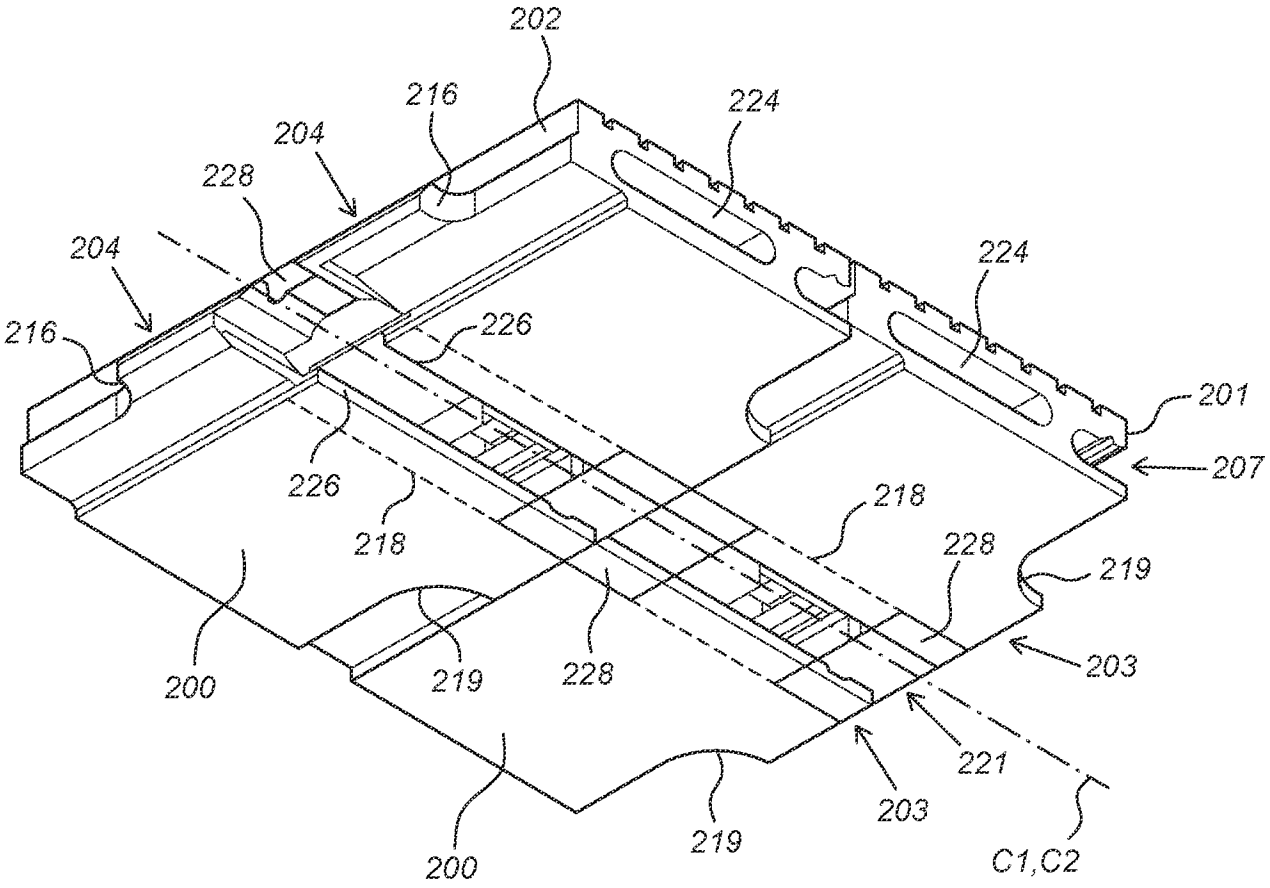

FIG. 7*a* shows (a segment of) two panels 200 in a first coupled condition. The panels 200 are shown in this figure from a bottom side in order to further elaborate on the third coupling profile 221 and the accommodating spaces 228 and bottom grooves, preferably transverse bottom grooves, 218 according to the present invention. The left panel 200, as shown from the bottom side in this figure is coupled to an adjacent (right, as shown from the bottom side in this figure) panel 200. In this respect a first coupling profile 204 of the right panel 200 is at least partially received by the second coupling profile 203 of the left panel 200. Hence, the tongue 208 of the first coupling profile 204 of the right panel 200 is inserted into the groove 207 of the left panel 200. As such, a mutual coupling in at least vertical and horizontal direction between the left and right panel 200 as shown is established. Each of the (segments of) the panels 200 as shown here comprises a bottom groove, preferably transverse bottom groove, 218, and also comprises a pair of accommodating spaces 228. As elucidated before, the accommodating space 228 may be defined by a pair of adjacent first coupling profiles 204 (but the same holds for a pair of second coupling profiles 203) which are situated at a mutual distance with respect to each other. The bottom groove, preferably transverse bottom groove, 218 is formed by a groove 218 in a central portion of the panel 200, which extends in a direction essentially perpendicular to the length of the panel 200. Preferably, at least one bottom groove, preferably transverse bottom groove, 218 is aligned with at least one accommodating space 228 (hence formed by either a pair of adjacent second coupling profiles 203 or a pair of adjacent first coupling profiles 204). Preferably, the at least one bottom groove, preferably transverse bottom groove, is aligned with two accommodating spaces 228, as is shown in this figure. For each of the panels 200, the bottom groove, preferably transverse bottom groove, 218 is aligned with the two accommodating spaces 228 of the respective panels 200. Hence, a continuous accommodating groove 218, 228 is established for each of the panels 200 in this figure. However, in this particular FIG. 7*a*, the two continuous accommodating grooves 218, 228 are not mutually aligned. Although the two continuous accommodating grooves 218, 228 of the two panels 200 are mutually parallel (as shown by centrelines C1, C2, they do not coincide. FIG. 7*b* shows (a segment of) two panels 200 in a second coupled condition. In this particular second example of the coupled panels 200, the two continuous accommodating spaces mutually align, causing the centrelines C1, C2 of said continuous accommodating spaces to coincide. That is, if one were to show a side perspective of the two coupled conditions as shown in FIGS. 7*a* and 7*b* respectively, one would be able to see through the coupled panels according to FIG. 7*b*, at least through the continuous accommodating space formed by the bottom grooves, preferably transverse bottom grooves, 218 and accommodating spaces 228 of the panels 200. In the latter FIG. 7*b*, it is to be noted that two accommodating spaces 228 mutually coincide, which explains why in this coupled condition of the panels 200 only three accommodating spaces 228 are visible. In this respect, the middle accommodating space 228 may be reflected to as a coinciding accommodating space 228. Yet, in comparing the two coupled conditions according to FIGS. 7*a* and 7*b* a second remark should be made. It is, after all, conceivable that a panel covering according to the present invention comprises some bottom grooves, preferably transverse bottom grooves, 218 and accommodating spaces 228, or continuous accommodating spaces, that align, and some that do not align. According to the aligned situation as shown in FIG. 7*b*, the support structure may be configured to be accommodated in said continuous accommodating groove 218, 228 along the entire length thereof. Moreover, it may be noted that, according to the aligned situation as shown in FIG. 7*b*, the third coupling profiles 221 of each of the panels 200 mutually align, which may form a common third coupling profile 221. This may allow the support structure 302, 303, to be anywhere along the common coupling profile 221 that is established by the aligned configuration. The third coupling profiles 221 according to FIGS. 7*a* and 7*b* comprise two, mutually facing and opposing, sideward tongues 226. Said two, mutually facing and opposing, sideward tongues 226 are configured to be at least partially accommodated in a groove 305 of the fourth coupling profile 304 of a first support structure 302.

Hence, the above-described inventive concepts are illustrated by several illustrative embodiments. It is conceivable that individual inventive concepts may be applied without, in so doing, also applying other details of the described example. It is not necessary to elaborate on examples of all conceivable combinations of the above-described inventive concepts, as a person skilled in the art will understand numerous inventive concepts can be (re)combined in order to arrive at a specific application. Various embodiments of the panel as described above and in the appended claims may be combined with this alternative panel configuration.

By "horizontal" is meant a direction which extends parallel to a plane defined by the floor panel, and which may intersect the core. By "vertical" is meant a direction which is perpendicular to said plane defined by the floor panel. The ordinal numbers used in this document, like "first", "second", and "third" are used only for identification purposes. Hence, the use of the expressions "third coupling profile" and "fourth coupling profile" does therefore not necessarily require the co-presence of a "first coupling profile" and/or "second coupling profile".

By "complementary" coupling profiles is meant that these coupling profiles can cooperate with each other. However, to this end, the complementary coupling profiles do not necessarily have to have complementary forms. The panel according to the invention may be applied, for example, as floor panel, but also as also applied as wall covering element, ceiling covering element, or alternative covering element. In this document, the directional expression "horizontal"

should be understood as being parallel to or falling together with a plane defined by the panel(s), and the direction expression "vertical" should be understood as perpendicular to the plane of the panel(s).

It will be apparent that the invention is not limited to the working examples shown and described herein, but that numerous variants are possible within the scope of the attached claims that will be obvious to a person skilled in the art.

The verb "comprise" and conjugations thereof used in this patent publication are understood to mean not only "comprise", but are also understood to mean the phrases "contain", "substantially consist of", "formed by" and conjugations thereof.

We claim:

1. A panel for composing a floor covering or wall covering, comprising:

a first edge that comprises a plurality of first coupling profiles, and a second edge, located opposed to the first edge, that comprises a plurality of second coupling profiles, wherein each second coupling profile is configured to engage interlockingly with at least one first coupling profile of an adjacent panel, both in horizontal direction and in vertical direction, wherein said first edge and/or said second edge comprises at least one drainage segment that is free of coupling profiles to facilitate flow-through of water in between the first edge of said panel and a facing second edge of the adjacent panel, in coupled condition of said panels, wherein the at least one first coupling profile comprises:

a sideward tongue extending in a direction substantially parallel to a plane defined by the panel; and wherein at least one second coupling profile comprises:

a groove configured for accommodating at least a part of the sideward tongue of the at least one first coupling profile of the adjacent panel, said groove being defined by an upper lip and a lower lip, wherein said lower lip extends beyond said upper lip, and wherein an upper surface of said lower lip comprises at least one upward drainage groove.

2. The panel according to claim 1, wherein the at least one drainage segment is enclosed by adjacent coupling profiles.

3. The panel according to claim 1, wherein at least one edge of the first edge and the second edge comprises at least three coupling profiles, wherein the at least one drainage segment is present in between each pair of adjacent first coupling profiles.

4. The panel according to claim 1, wherein the at least one drainage segment is substantially delimited by a vertical plane defined by a corresponding edge.

5. The panel according to claim 1, wherein the first edge comprises at least one first drainage segment, and wherein the second edge comprises at least one second drainage segment.

6. The panel according to claim 5, wherein the at least one first drainage segment is at least partially aligned with the at least one second drainage segment, such that said at least one first drainage segment of said panel is facing said at least one second drainage segment of the adjacent panel, in coupled condition of said panels, and further wherein the length of the at least one first drainage segment exceeds the length of the at least one second drainage segment.

7. The panel according to claim 1, wherein the length of the at least one drainage segment exceeds the length of at least one adjacent coupling profile.

8. The panel according to claim 1, wherein the first and second coupling profile are configured such that two of such panels can be coupled to each other by a turning movement, wherein, in coupled condition: at least a part of the sideward tongue of a first panel is inserted into the groove of an adjacent, second panel, and wherein at least one second locking element of said first panel faces, and co-acts with, a first locking element of said adjacent panel to interlock both panels both in the horizontal and vertical direction.

9. The panel according to claim 1, wherein the lower lip comprises an inner segment that is positioned directly below the upper lip, and a connecting outer segment that extends beyond an outer vertical plane defined by the upper lip, wherein the maximum height of the inner segment is identical to or exceeds the maximum height of the outer segment, and further wherein the upper surface of the outer segment of the lower lip comprises the at least one upward drainage groove.

10. The panel according to claim 1, wherein the lower lip of said panel is configured to engage a stop surface of the second coupling profile of the adjacent panel, in coupled condition of said panels, wherein said stop surface is located at a lower level than the sideward tongue.

11. The panel according to claim 1, wherein a lower side of the panel is provided with a longitudinal cut-out portion connecting and parallel to the first edge for accommodating each lower lip in coupled condition of adjacent panels.

12. The panel according to claim 1, wherein the at least one first coupling profile comprises a first top portion located above the sideward tongue, wherein said first top portion extends in a substantially vertical direction, and wherein an outer end of the upper lip defines a second top portion, wherein said second top portion extends in a substantially vertical direction, and wherein said second top portion is configured to face the first top portion of the adjacent panel, in coupled condition of said panels, such that the first top portion and the facing second top portion are positioned at a distance from each other.

13. The panel according to claim 1, wherein the lower lip is provided with at least one curved side edge.

14. The panel according to claim 1, wherein the sideward tongue is provided with at least one curved side edge.

15. The panel according to claim 1, wherein at least two first coupling profiles are identical.

16. The panel according to claim 1, wherein at least two first coupling profiles, as seen from a top view, are mirror symmetric first coupling profiles, and wherein at least two second coupling profiles, as seen from a top view, are mirror symmetric second coupling profiles.

17. The panel according to claim 1, wherein each pair of at least one pair of adjacent first coupling profiles and at least one pair of opposing adjacent second coupling profiles encloses an accommodating space for accommodating a separate support structure for supporting said panel, wherein accommodating spaces are aligned with each other.

18. The panel according to claim 1, wherein a lower side of the panel comprises at least one bottom groove, connecting the first edge and the second edge, wherein said at least one bottom groove is configured to accommodate a separate support structure for supporting said panel, and wherein the at least one bottom groove is connected and aligned with a pair of opposing, aligned accommodating spaces to form a continuous accommodating groove for accommodating a part of said separate support structure, and further wherein at least one accommodating space and/or the at least one bottom groove comprises at least one third coupling profile configured to interlockingly engage with at least one fourth coupling profile of said separate support structure, in the horizontal direction and/or the vertical direction.

19. The panel according to claim 1, wherein a second pair of opposing edges, in particular a third edge and a fourth edge, of the panel is entirely free of coupling profiles.

20. The panel according to claim 1, wherein an upper side of said sideward tongue comprises at least one first locking element in a form of an upwardly protruding locking element, and wherein a lower side of said upper lip comprises at least one second locking element in a form of a downwardly facing recess, configured to face, and co-act with, the at least one first locking element of the adjacent panel, in coupled condition of said panels to interlock the panels in the horizontal direction.

21. A panel system for composing a floor covering or wall covering, in particular for outdoor use, comprising:

at least one panel according to claim 1, and at least one first support structure configured to be partially accommodated within at least one pair of aligned accommodating spaces and/or bottom groove applied in the lower side of said panel.

* * * * *